US011574590B2

(12) United States Patent
Kim et al.

(10) Patent No.: US 11,574,590 B2
(45) Date of Patent: Feb. 7, 2023

(54) DISPLAY APPARATUS

(71) Applicants: Samsung Display Co., Ltd., Yongin-Si (KR); Konkuk University Industrial Cooperation Corp., Seoul (KR)

(72) Inventors: Dongwoo Kim, Yongin-si (KR); Joon Ho Lee, Seongnam-si (KR); Kee Chan Park, Seoul (KR); Minkyu Woo, Seoul (KR); Chongchul Chai, Seoul (KR)

(73) Assignees: Samsung Display Co., Ltd.; Konkuk University Industrial Cooperation Corp.

( * ) Notice: Subject to any disclaimer, the term of this patent is extended or adjusted under 35 U.S.C. 154(b) by 0 days.

(21) Appl. No.: 17/695,588

(22) Filed: Mar. 15, 2022

(65) Prior Publication Data

US 2022/0358878 A1 Nov. 10, 2022

(30) Foreign Application Priority Data

May 4, 2021 (KR) ..... 10-2021-0057930

(51) Int. Cl.
*G09G 3/3225* (2016.01)

(52) U.S. Cl.
CPC ... *G09G 3/3225* (2013.01); *G09G 2300/0842* (2013.01); *G09G 2310/061* (2013.01); *G09G 2320/0233* (2013.01)

(58) Field of Classification Search
None
See application file for complete search history.

(56) References Cited

U.S. PATENT DOCUMENTS

2006/0208979 A1 9/2006 Fish et al.
2013/0082906 A1* 4/2013 Toyomura ..... G09G 3/3233 345/55

(Continued)

FOREIGN PATENT DOCUMENTS

CN 1601594 A 3/2005
CN 106847111 A 6/2017
CN 107705713 A 2/2018

*Primary Examiner* — Sepehr Azari
(74) *Attorney, Agent, or Firm* — Innovation Counsel LLP

(57) ABSTRACT

A display apparatus is disclosed, which includes a pixel. The pixel includes first through fifth transistors and a light emitting element. The first transistor includes a control electrode electrically connected to a first node, an input electrode that receives a first power voltage and an output electrode electrically connected to the light emitting element. The second transistor includes a control electrode that receives a scan signal, an input electrode that receives a grayscale data voltage and an output electrode electrically connected to a second node. The third transistor includes a control electrode electrically connected to the second node, an input electrode that receives a reference voltage and an output electrode electrically connected to the first node. The fourth transistor includes a control electrode that receives the scan signal, an input electrode that receives a bias data voltage and an output electrode electrically connected to the first node. The fifth transistor includes a control electrode that receives a sensing control signal, an input electrode that receives an initialization voltage and an output electrode electrically connected to the light emitting element.

22 Claims, 28 Drawing Sheets

(56) References Cited

U.S. PATENT DOCUMENTS

| | | | | |
|---|---|---|---|---|
| 2013/0083000 | A1* | 4/2013 | Toyomura | G09G 3/3233<br>345/212 |
| 2015/0154899 | A1 | 6/2015 | Chang et al. | |
| 2018/0301080 | A1* | 10/2018 | Shigeta | G09G 3/2014 |
| 2022/0114951 | A1* | 4/2022 | Chang | G09G 3/14 |

* cited by examiner

DISPLAY APPARATUS

PRIORITY STATEMENT

This application claims priority under 35 U.S.C. § 119 to Korean Patent Application No. 10-2021-0057930, filed on May 4, 2021 in the Korean Intellectual Property Office KIPO, the contents of which are herein incorporated by reference in their entireties.

BACKGROUND

1. Field

The present inventive concept relates to a display apparatus. More particularly, the present inventive concept relates to a pixel of a display apparatus.

2. Description of the Related Art

Generally, a display apparatus includes a display panel and a display panel driver. The display panel includes a plurality of gate lines, a plurality of data lines and a plurality of pixels. The display panel driver includes a gate driver and a data driver. The gate driver outputs gate signals to the gate lines. The data driver outputs data voltages to the data lines.

The display panel may include a light emitting diode as a light emitting element. A emission wavelength of the light emitting diode may change according to a current magnitude so that a pulse amplitude modulation method may produce grayscales by controlling the current magnitude applied to the light emitting diode.

In addition, in a simultaneous emission method in which a frame is divided into an addressing period when a data voltage is applied to a pixel and a light emitting period when a light emitting element emits a light, the light emitting period for a high resolution display apparatus may be shortened so that the current for producing a desired luminance may increase. When the current for producing the desired luminance increases, a driving voltage may increase and cause a power consumption to increase.

SUMMARY

In an embodiment of a display apparatus according to the present inventive concept, the display apparatus includes a pixel. The pixel includes a first transistor, a second transistor, a third transistor, a fourth transistor, a fifth transistor and a light emitting element. The first transistor includes a control electrode electrically connected to a first node, an input electrode configured to receive a first power voltage and an output electrode electrically connected to a first electrode of the light emitting element. The second transistor includes a control electrode configured to receive a scan signal, an input electrode configured to receive a grayscale data voltage and an output electrode electrically connected to a second node. The third transistor includes a control electrode electrically connected to the second node, an input electrode configured to receive a reference voltage and an output electrode electrically connected to the first node. The fourth transistor includes a control electrode configured to receive the scan signal, an input electrode configured to receive a bias data voltage and an output electrode electrically connected to the first node. The fifth transistor includes a control electrode configured to receive a sensing control signal, an input electrode configured to receive an initialization voltage and an output electrode electrically connected to the first electrode of the light emitting element. The light emitting element includes the first electrode and a second electrode configured to receive a second power voltage.

In an embodiment, the pixel may further include a storage capacitor including a first end portion electrically connected to the first node and a second end portion electrically connected to the first electrode of the light emitting element and a sweeping capacitor including a first end portion configured to receive a sweeping signal and a second end portion electrically connected to the second node.

In an embodiment, in a first period of a display mode in which the pixel is configured to display an image based on the grayscale data voltage, the scan signal may have an active level, the sensing control signal may have an active level, the sweeping signal may have an inactive level and the grayscale data voltage may be a precharge data voltage.

In an embodiment, in a second period of the display mode subsequent to the first period of the display mode, the scan signal may have the active level, the sensing control signal may have the active level, the sweeping signal may have the inactive level and the grayscale data voltage may be a main data voltage.

In an embodiment, in a third period of the display mode subsequent to the second period of the display mode, the scan signal may have an inactive level, the sensing control signal may have the active level and the sweeping signal may have the inactive level.

In an embodiment, in a fourth period of the display mode subsequent to the third period of the display mode, the scan signal may have the inactive level, the sensing control signal may have an inactive level, the sweeping signal may be gradually increased, the first transistor may be configured to be turned on and the third transistor may be configured to be turned off so that the light emitting element may be configured to emit a light.

In an embodiment, in a fifth period of the display mode subsequent to the fourth period of the display mode, the scan signal may have the inactive level, the sensing control signal may have the inactive level, the sweeping signal may be gradually increased, the third transistor may be configured to be turned on and the first transistor may be configured to be turned off so that the light emitting element may be configured not to emit the light.

In an embodiment, the display apparatus may further include a first switch including a first end portion electrically connected to the input electrode of the fifth transistor and a second end portion configured to receive the initialization voltage, a second switch including a first end portion electrically connected to the input electrode of the fifth transistor and a second end portion electrically connected to an analog to digital converter and a sensing capacitor electrically connected to the input electrode of the fifth transistor.

In an embodiment, in a first period of a first sensing mode to sense a characteristic of the first transistor, the scan signal may have an inactive level, the sensing control signal may have an inactive level, a first switch control signal applied to the first switch may have an active level and a second switch control signal applied to the second switch may have an inactive level.

In an embodiment, in a second period of the first sensing mode subsequent to the first period of the first sensing mode, the scan signal may have an active level, the sensing control signal may have an active level, the first switch control signal may have the active level and the second switch control signal may have the inactive level.

In an embodiment, in a third period of the first sensing mode subsequent to the second period of the first sensing mode, the scan signal may have the inactive level, the sensing control signal may have the active level, the first switch control signal may have an inactive level, the second switch control signal may have the inactive level and a first sensing voltage may be gradually charged at the sensing capacitor.

In an embodiment, in a fourth period of the first sensing mode subsequent to the third period of the first sensing mode, the scan signal may have the active level, the sensing control signal may have the inactive level, the first switch control signal may have the inactive level, the second switch control signal may have an active level and the first sensing voltage may be outputted from the sensing capacitor to the analog to digital converter.

In an embodiment, in a first period of a second sensing mode to sense a characteristic of the third transistor, the scan signal may have an inactive level, the sensing control signal may have an inactive level, a first switch control signal applied to the first switch may have an active level and a second switch control signal applied to the second switch may have an inactive level.

In an embodiment, in a second period of the second sensing mode subsequent to the first period of the second sensing mode, the scan signal may have an active level, the sensing control signal may have an active level, the first switch control signal may have the active level and the second switch control signal may have the inactive level.

In an embodiment, in a third period of the second sensing mode subsequent to the second period of the second sensing mode, the scan signal may have the inactive level, the sensing control signal may have the active level, the first switch control signal may have an inactive level, the second switch control signal may have the inactive level, the sweeping signal may be gradually increased and a second sensing voltage may be gradually charged at the sensing capacitor.

In an embodiment, in a fourth period of the second sensing mode subsequent to the third period of the second sensing mode, the scan signal may have the inactive level, the sensing control signal may have the inactive level, the first switch control signal may have the inactive level, the second switch control signal may have an active level and the second sensing voltage may be outputted from the sensing capacitor to the analog to digital converter.

In an embodiment of a display apparatus according to the present inventive concept, the display apparatus includes a pixel, a gate driver and a data driver. The gate driver is configured to output a gate signal to the pixel. The data driver is configured to output a data voltage to the pixel. The pixel may include a first transistor including a control electrode electrically connected to a first node, an input electrode configured to receive a first power voltage and an output electrode electrically connected to a first electrode of a light emitting element, a second transistor including a control electrode configured to receive a scan signal, an input electrode configured to receive a grayscale data voltage and an output electrode electrically connected to a second node, a third transistor including a control electrode electrically connected to the second node, an input electrode configured to receive a reference voltage and an output electrode electrically connected to the first node, a fourth transistor including a control electrode configured to receive the scan signal, an input electrode configured to receive a bias data voltage and an output electrode electrically connected to the first node, a fifth transistor including a control electrode configured to receive a sensing control signal, an input electrode configured to receive an initialization voltage and an output electrode electrically connected to the first electrode of the light emitting element and the light emitting element including the first electrode and a second electrode configured to receive a second power voltage.

In an embodiment, wherein the pixel may further include a storage capacitor including a first end portion electrically connected to the first node and a second end portion electrically connected to the first electrode of the light emitting element and a sweeping capacitor including a first end portion configured to receive a sweeping signal and a second end portion electrically connected to the second node.

In an embodiment, the pixel may be configured to operate in one of a display mode, a first sensing mode and a second sensing mode. In the display mode, the pixel may be configured to display an image based on the grayscale data voltage. In the first sensing mode, a characteristic of the first transistor may be sensed. In the second sensing mode, a characteristic of the third transistor may be sensed.

In an embodiment, the display panel may be configured to be driven in a unit of a frame. The frame may include an active period when the grayscale data voltages are sequentially written to the pixels and a vertical blank period when the grayscale data voltages are not written to the pixels. The first sensing mode may be configured to be operated in the vertical blank period. The second sensing mode may be configured to be operated in a power off duration when the display apparatus is turned off.

In an embodiment, the display panel may be configured to be driven in a unit of a frame. The frame may include an active period when the grayscale data voltages are sequentially written to the pixels and a vertical blank period when the grayscale data voltages are not written to the pixels. The first sensing mode may be configured to be operated in the vertical blank period. The first sensing mode and the second sensing mode may be configured to be operated in a power off duration when the display apparatus is turned off.

In an embodiment, the display panel may be configured to be driven in a unit of a frame. The frame may include an active period when the grayscale data voltages are sequentially written to the pixels and a vertical blank period when the grayscale data voltages are not written to the pixels. The first sensing mode and the second sensing mode may be configured to be operated in the vertical blank period.

BRIEF DESCRIPTION OF THE DRAWINGS

The above and other features and advantages of the present inventive concept will become more apparent by describing in detailed embodiments thereof with reference to the accompanying drawings, in which.

DETAILED DESCRIPTION OF THE INVENTIVE CONCEPT

Embodiments of the present inventive concept may include a display apparatus displaying an image in a pulse width modulation method or in a progressive emission method. According to embodiments, the pulse width modulation may improve luminance consistency for grayscales produced by light emitting diodes of the display apparatus. According to embodiments, the progressive emission method may adjust timing of light emission by horizontal lines of pixels, which allows the display apparatus to be driven with a relatively low driving voltage to reduce power consumption.

Embodiments of the present inventive concept allow sensing characteristics of some transistors of a pixel and, upon deviations of the characteristics, compensating for the deviations.

Hereinafter, the present inventive concept will be explained in detail with reference to the accompanying drawings.

Figure 1:
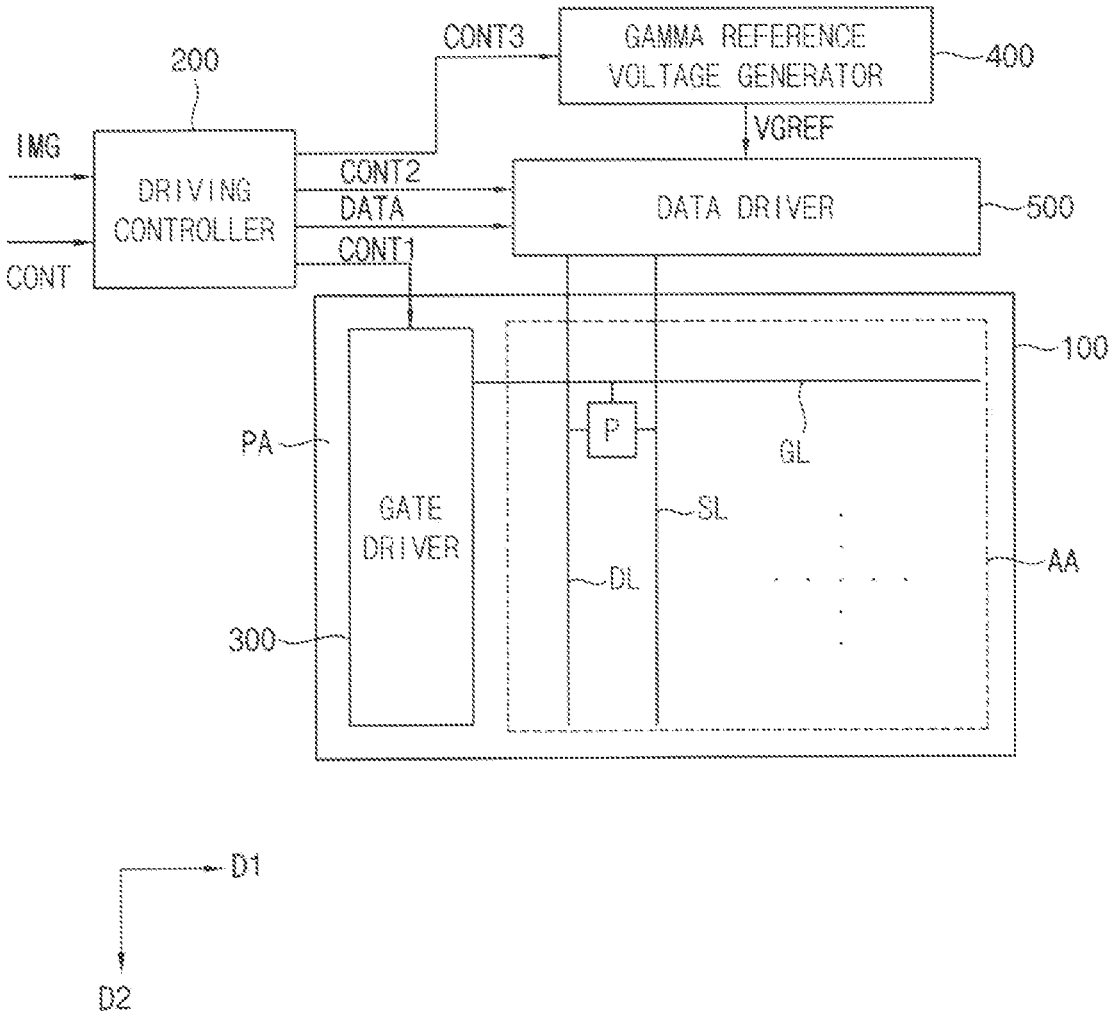
FIG. 1 is a block diagram illustrating a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region AA on which an image is displayed and a peripheral region PA adjacent to the display region AA.

For example, in the present embodiment, the display panel 100 may be a light emitting diode display panel including a light emitting diode. For example, the display panel 100 may be an organic light emitting diode display panel including an organic light emitting diode. For example, the display panel 100 may be a quantum dot organic light emitting diode display panel including an organic light emitting diode and a quantum dot color filter. For example, the display panel 100 may be a quantum dot nano light emitting diode display panel including a nano light emitting diode and a quantum dot color filter. For example, the display panel 100 may be a liquid crystal display panel including a liquid crystal layer.

The display panel 100 includes a plurality of gate lines GL, a plurality of data lines DL and a plurality of pixels P connected to the gate lines GL and the data lines DL. The gate lines GL may extend in a first direction D1 and the data lines DL may extend in a second direction D2 crossing the first direction D1.

In the present embodiment, the display panel 100 may further include a plurality of sensing lines SL connected to the pixels P. The sensing lines SL may extend in the second direction D2.

In the present embodiment, the display panel driver may include a sensing circuit receiving a sensing signal from the pixels P of the display panel 100 through sensing lines SL. For example, the sensing circuit may be disposed in the data driver 500. When the data driver 500 has an integrated chip (IC) type, the sensing circuit may be disposed in a data driving IC. Alternatively, the sensing circuit may be formed independently from the data driver 500. However, the present inventive concept may not be limited to a position of the sensing circuit.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

In an embodiment, the gate driver 300 may be integrated on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
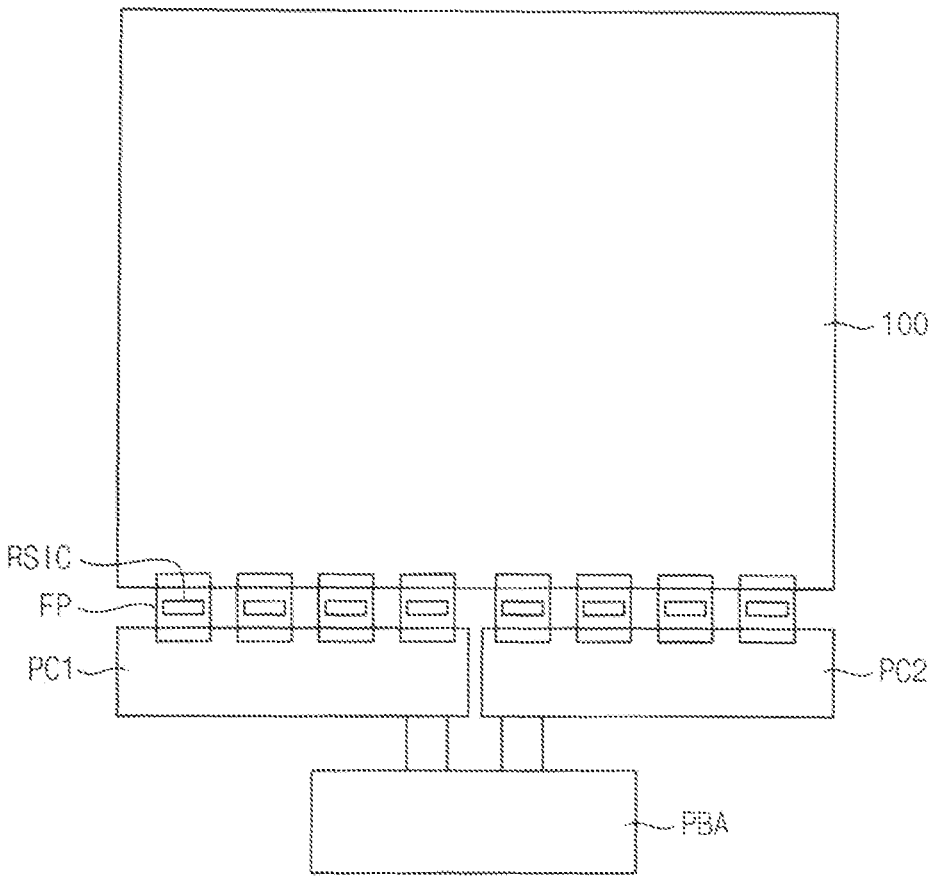
FIG. 2 is a plan view illustrating the display apparatus of FIG. 1.

FIG. 2 is a plan view illustrating the display apparatus of FIG. 1.

Referring to FIGS. 1 and 2, the display apparatus may include a printed circuit board assembly PBA, a first printed circuit PC1 and a second printed circuit PC2. The printed circuit board assembly PBA may be connected to the first printed circuit PC1 and the second printed circuit PC2. For example, the driving controller 200 may be disposed on the printed circuit board assembly PBA.

The display apparatus may further include a plurality of flexible circuits FP connected to the first printed circuit PC1 and the display panel 100. The display apparatus may further include another plurality of flexible circuits FP connected to the second printed circuit PC2 and the display panel 100.

Data driving chips RSIC of the data driver 500 may be disposed on the flexible circuits FP. The data driving chip RSIC may be an integrated circuit chip. The sensing circuit may be disposed in the data driving chip RSIC. For example, the data driving chips RSIC may operate both a function outputting the data voltage to the display panel 100 and a function receiving the sensing signal form the display panel 100.

Figure 3:
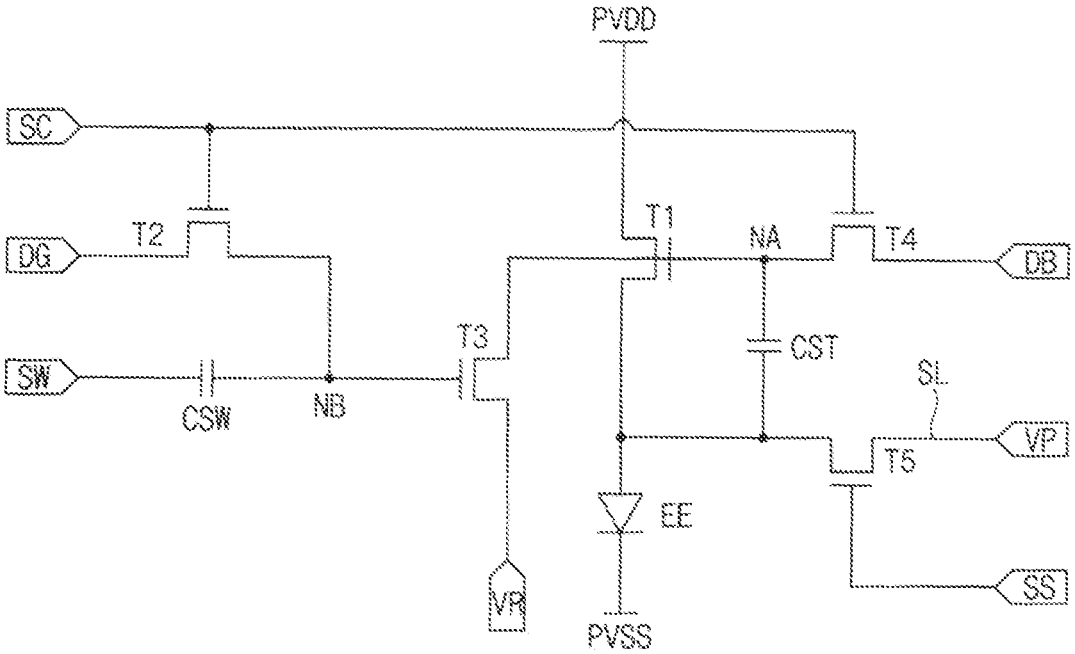
FIG. 3 is a circuit diagram illustrating a pixel of FIG. 1.

FIG. 3 is a circuit diagram illustrating the pixel P of FIG. 1. The pixel P illustrated in FIGS. 3, 4, 6, 8, 10, 12, 15, 17, 19, 21, 23, 25, 27 and 29 may mean a pixel disposed in an N-th pixel row.

Referring to FIGS. 1 to 3, the pixel P includes a first transistor T1, a second transistor T2, a third transistor T3, a fourth transistor T4, a fifth transistor T5 and a light emitting element EE. The first transistor T1 includes a control electrode connected to a first node NA, an input electrode receiving a first power voltage PVDD and an output electrode connected to a first electrode of the light emitting element EE. The second transistor T2 includes a control electrode receiving a scan signal SC, an input electrode receiving a grayscale data voltage DG and an output electrode connected to a second node NB. The third transistor T3 includes a control electrode connected to the second node NB, an input electrode receiving a reference voltage VR and an output electrode connected to the first node NA. The fourth transistor T4 includes a control electrode receiving the scan signal SC, an input electrode receiving a bias data voltage DB and an output electrode connected to the first node NA. The fifth transistor T5 includes a control electrode receiving a sensing control signal SS, an input electrode receiving an initialization voltage VP and an output electrode connected to the first electrode of the light emitting element EE. The light emitting element EE includes the first electrode and a second electrode receiving a second power voltage PVSS.

For example, the first power voltage PVDD may be a higher power voltage. The second power voltage PVSS may be a lower power voltage which is less than the first power voltage PVDD.

The pixel P may further include a storage capacitor CST including a first end portion connected to the first node NA and a second end portion connected to the first electrode of the light emitting element EE and a sweeping capacitor CSW including a first end portion receiving a sweeping signal SW and a second end portion connected to the second node NB.

For example, the gate driver 300 may output the scan signal SC, the sweeping signal SW and the sensing control signal SS to the pixel P. For example, the data driver 500 may output the grayscale data voltage DG and the bias data voltage DB to the pixel P.

The pixel P may operate in one of a display mode, a first sensing mode and a second sensing mode. In the display mode, the pixel may display an image based on the grayscale data voltage DG. In the first sensing mode, a characteristic of the first transistor T1 may be sensed. In the second sensing mode, a characteristic of the third transistor T3 may be sensed. Herein, the characteristic of the first transistor T1 may be a threshold voltage of the first transistor T1. Herein, the characteristic of the third transistor T3 may be a threshold voltage of the third transistor T3.

Figure 4:
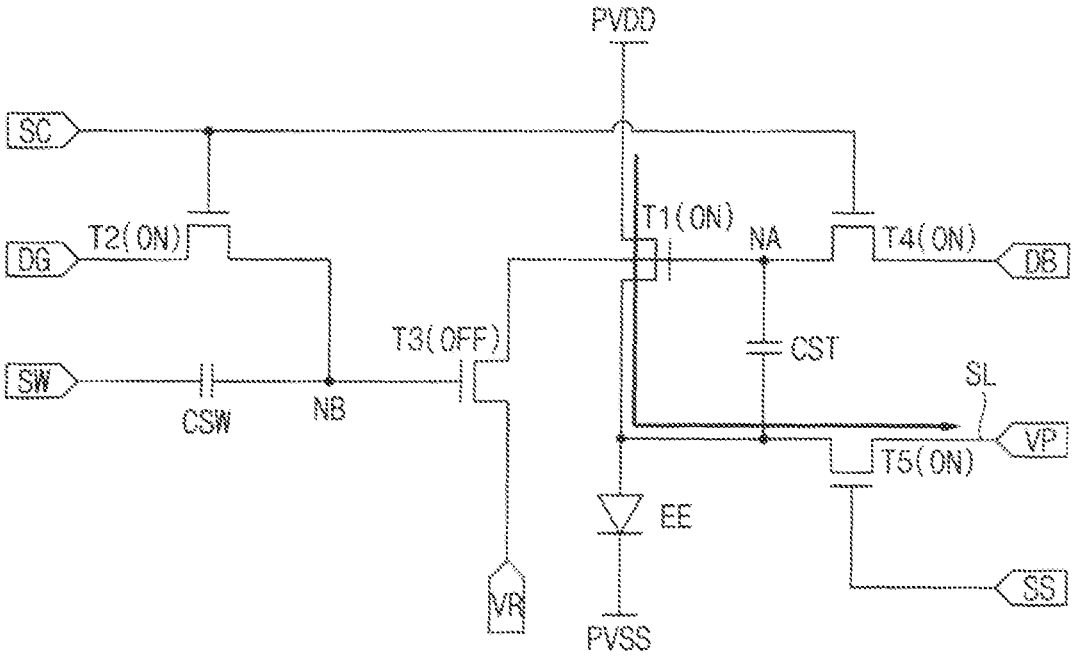
FIG. 4 is a circuit diagram illustrating the pixel of FIG. 1 in a first period of a display mode.
Figure 5:
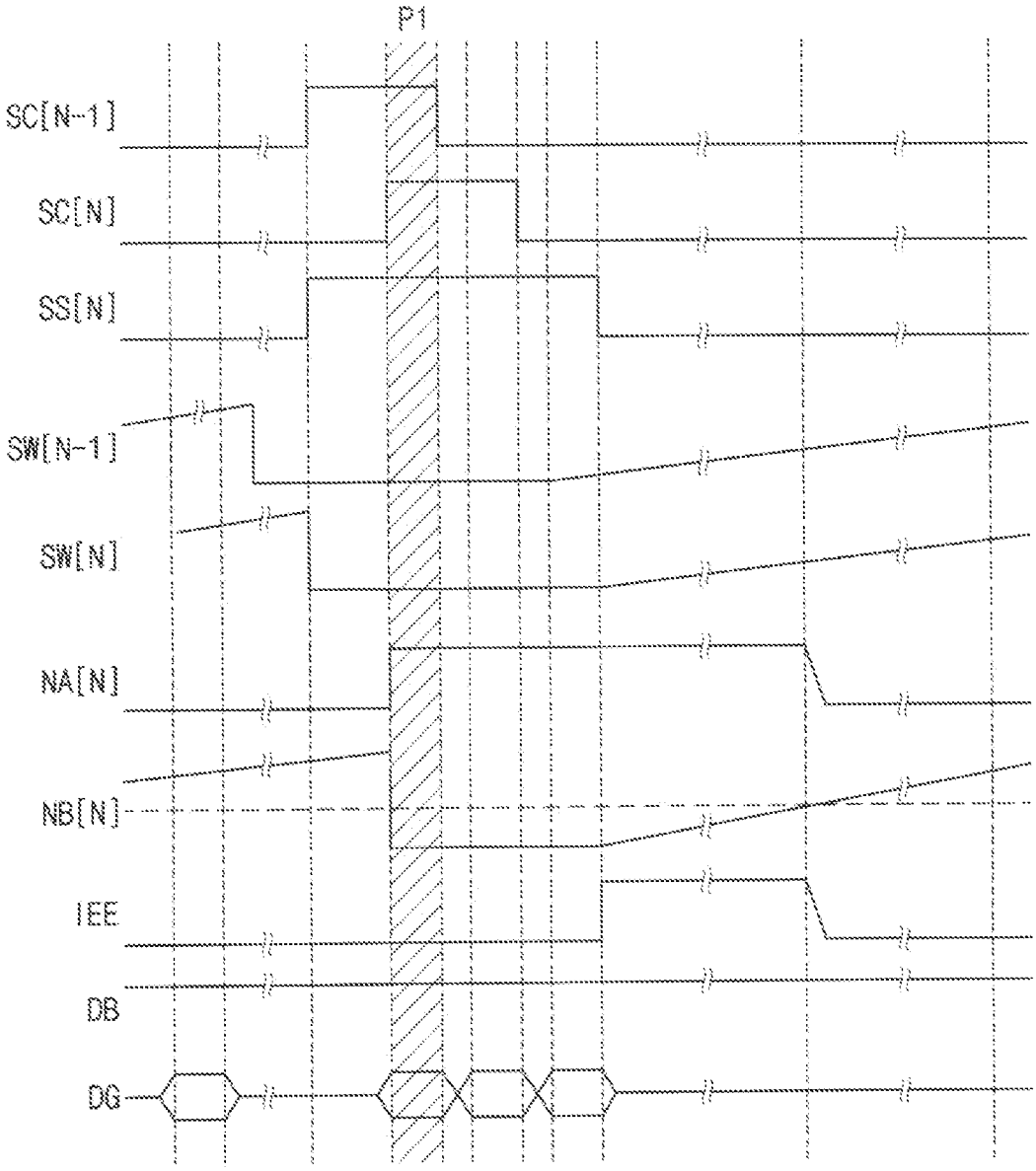
FIG. 5 is a timing diagram illustrating input signals and node signals of the pixel of FIG. 1 in the first period of the display mode.

FIG. 4 is a circuit diagram illustrating the pixel P of FIG. 1 in a first period P1 of the display mode. FIG. 5 is a timing diagram illustrating input signals and node signals of the pixel P of FIG. 1 in the first period P1 of the display mode.

Referring to FIGS. 1 to 5, in the first period P1 of the display mode, the scan signal SC may have an active level, the sensing control signal SS may have an active level, the sweeping signal SW may have an inactive level and the grayscale data voltage DG may be a precharge data voltage. Herein, [N] may mean a signal of a present horizontal line and [N−1] may mean a signal of a previous horizontal line.

The first period P1 of the display mode may be a precharge period. In the first period P1 of the display mode, the second transistor T2 and the fourth transistor T4 may be turned on in response to the scan signal SC so that the bias data voltage DB may be applied to the first node NA and the grayscale data voltage DG may be applied to the second node NB. Herein, the grayscale data voltage DG may be a precharge data voltage for the present horizontal line which is a main data voltage for the previous horizontal line.

For example, the bias data voltage DB may be a direct current (DC) voltage to turn on the first transistor T1 in the display mode. For example, the initialization voltage VP may be a direct current (DC) voltage of a lower level to generate a current path.

The bias data voltage DB may have a higher level, the first transistor T1 may be turned on in response to the bias data voltage DB and the fifth transistor T5 may be turned on in response to the sensing control signal SS. The initialization voltage VP applied to the input electrode of the fifth transistor T5 has a lower level so that a current path is generated in a direction from the first power voltage PVDD to the initialization voltage VP through the first transistor T1 and the fifth transistor T5 in the first period P1 of the display mode. Thus, the light emitting element EE may not be turned on in the first period P1 of the display mode.

In addition, the grayscale data voltage DG may define an initial lower level for the second node NB. The grayscale data voltage DG applied to the second node NB may vary according to a grayscale value, but the grayscale data voltage DG may not be quite high enough to turn on the third transistor T3 regardless of the grayscale value. Thus, the third transistor T3 may be turned off in the first period P1 of the display mode.

Figure 6:
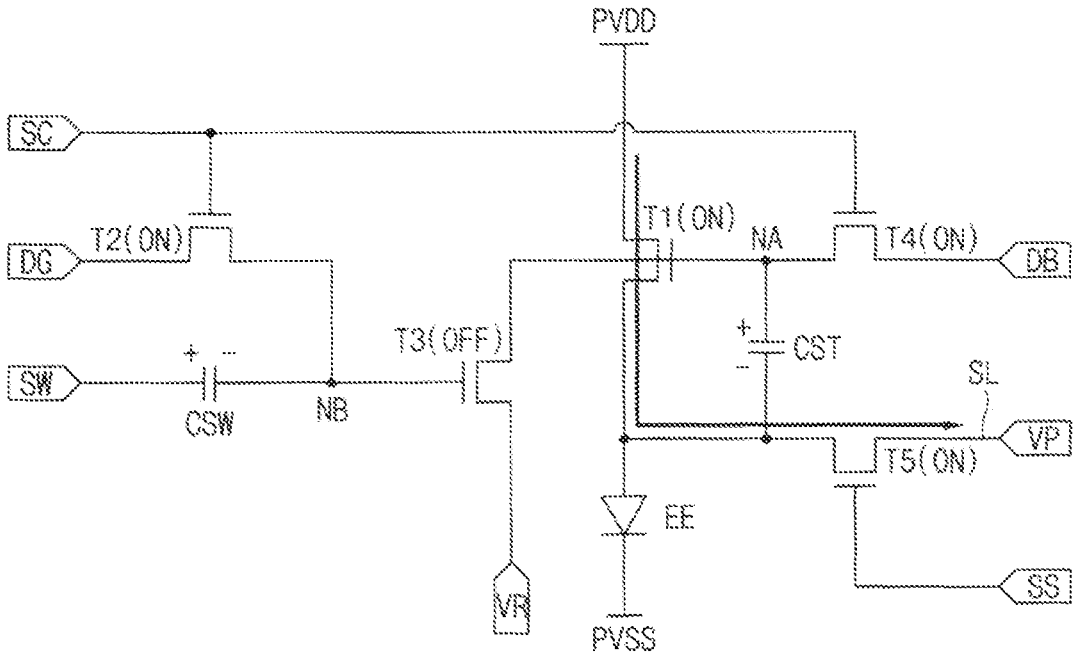
FIG. 6 is a circuit diagram illustrating the pixel of FIG. 1 in a second period of the display mode.
Figure 7:
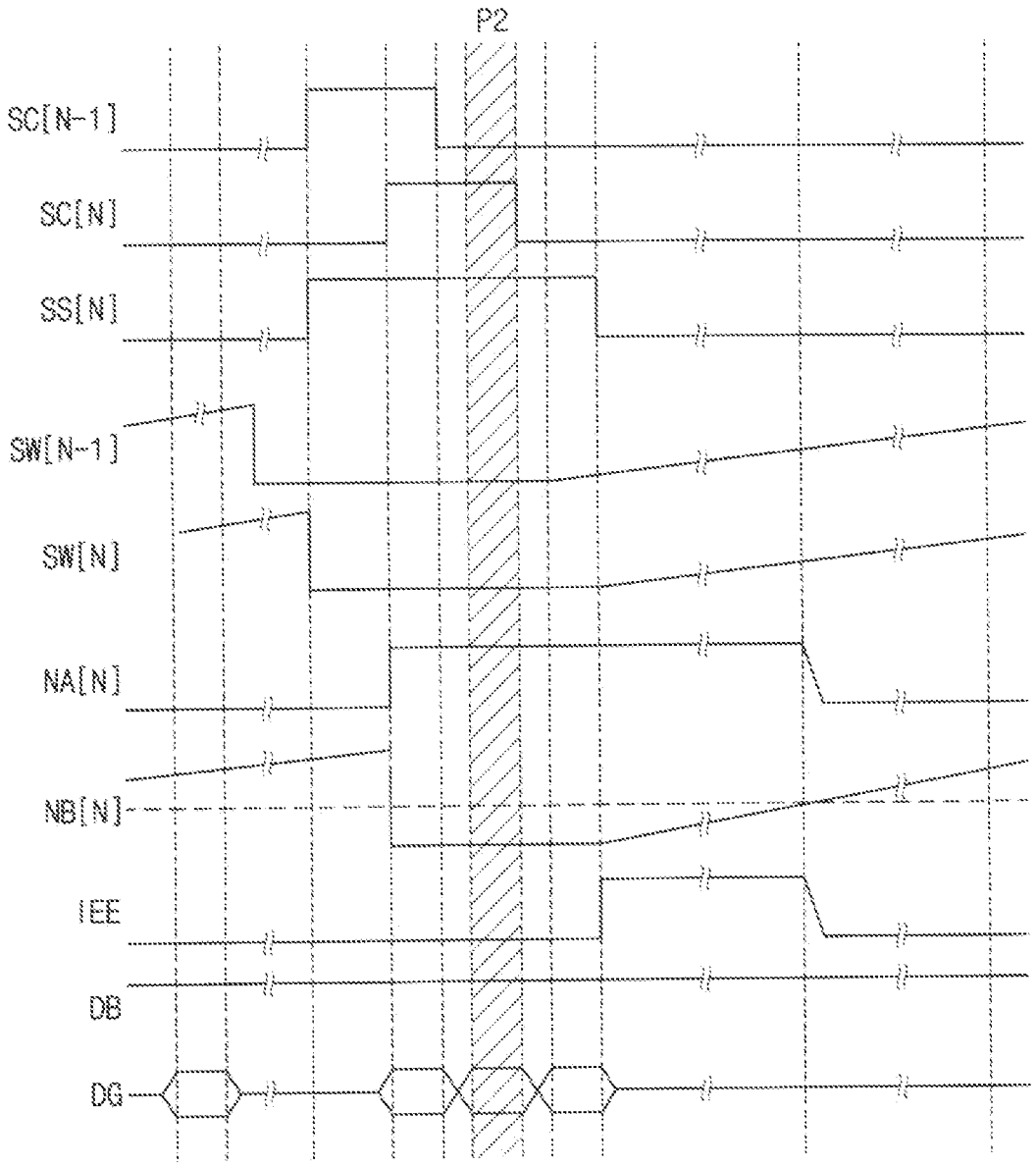
FIG. 7 is a timing diagram illustrating input signals and node signals of the pixel of FIG. 1 in the second period of the display mode.

FIG. 6 is a circuit diagram illustrating the pixel P of FIG. 1 in a second period P2 of the display mode. FIG. 7 is a timing diagram illustrating input signals and node signals of the pixel P of FIG. 1 in the second period P2 of the display mode.

Referring to FIGS. 1 to 7, in the second period P2 of the display mode which is subsequent to the first period P1 of the display mode, the scan signal SC may have the active level, the sensing control signal SS may have the active level, the sweeping signal SW may have the inactive level and the grayscale data voltage DG may be a main data voltage.

The second period P2 of the display mode may be a main charge period. In the second period P2 of the display mode, the second transistor T2 and the fourth transistor T4 may be turned on in response to the scan signal SC so that the bias data voltage DB may be applied to the first node NA and the grayscale data voltage DG may be applied to the second node NB. Herein, the grayscale data voltage DG may be a main charge data voltage for the present horizontal line.

The bias data voltage DB may have a higher level, the first transistor T1 may be turned on in response to the bias data voltage DB and the fifth transistor T5 may be turned on in response to the sensing control signal SS. The initialization voltage VP applied to the input electrode of the fifth transistor T5 has a lower level so that a current path is generated in a direction from the first power voltage PVDD to the initialization voltage VP through the first transistor T1 and the fifth transistor T5 in the second period P2 of the display mode. Thus, the light emitting element EE may not be turned on in the second period P2 of the display mode.

In addition, the grayscale data voltage DG may define an initial lower level for the second node NB. The grayscale data voltage DG applied to the second node NB may vary according to a grayscale value, but the grayscale data voltage DG may not be quite high enough to turn on the third transistor T3 regardless of the grayscale value. Thus, the third transistor T3 may be turned off in the second period P2 of the display mode.

In the second period P2 of the display mode, a voltage charged at the sweeping capacitor CSW may be a difference between the sweeping signal SW and the grayscale data voltage DG. Herein, the sweeping signal SW may have a level higher than the level of the grayscale data voltage DG. In addition, in the second period P2 of the display mode, a voltage charged at the storage capacitor CST may be a difference between the bias data voltage DB and the initialization voltage VP. Herein, the bias data voltage DB applied to the first node NA may have a level higher than the level of the initialization voltage VP.

Figure 8:
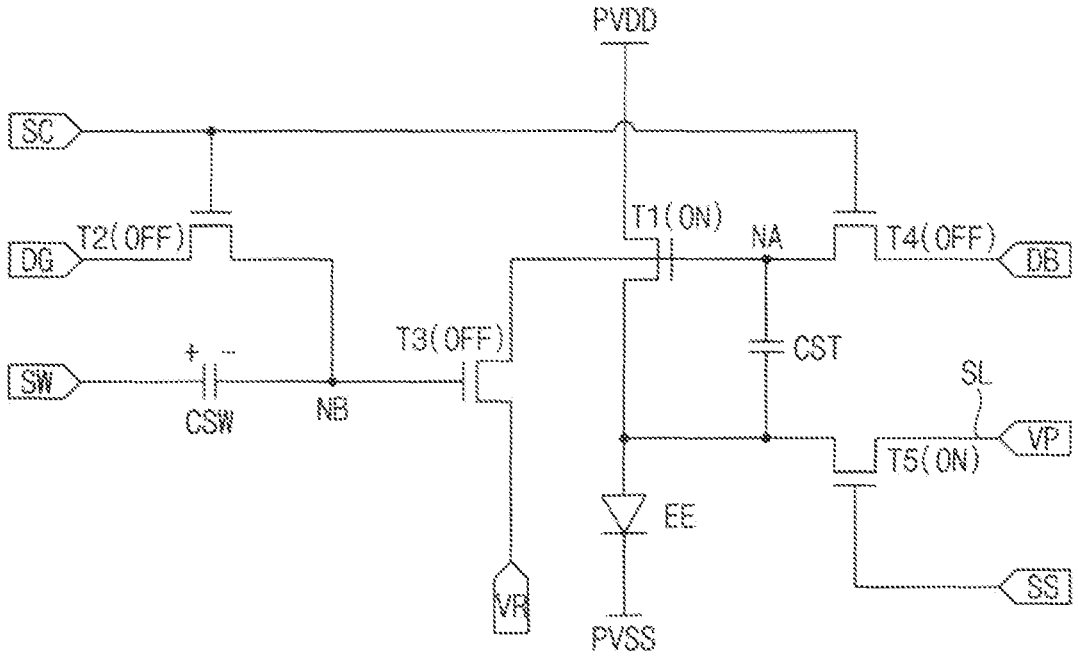
FIG. 8 is a circuit diagram illustrating the pixel of FIG. 1 in a third period of the display mode.
Figure 9:
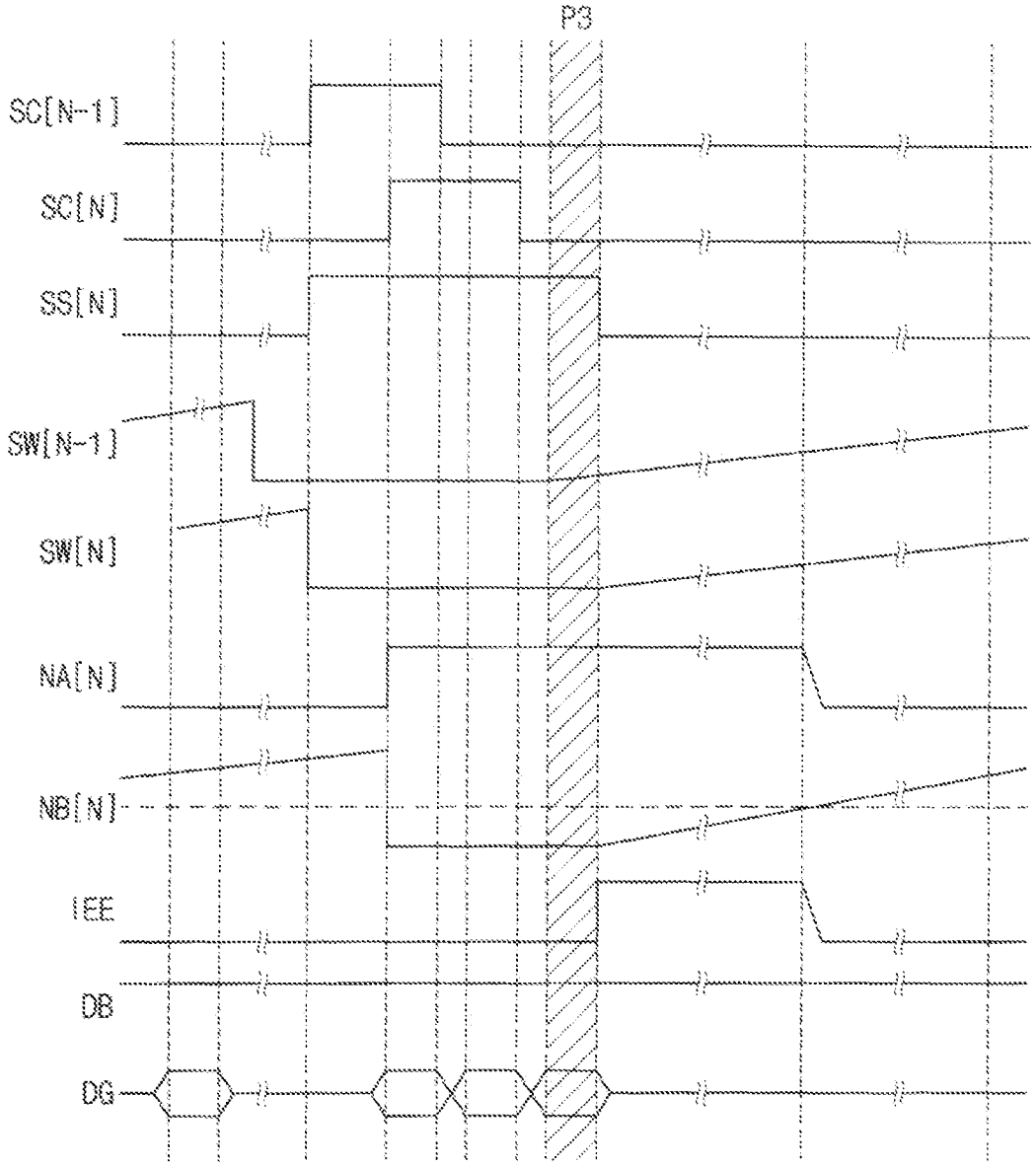
FIG. 9 is a timing diagram illustrating input signals and node signals of the pixel of FIG. 1 in the third period of the display mode.

FIG. 8 is a circuit diagram illustrating the pixel P of FIG. 1 in a third period P3 of the display mode. FIG. 9 is a timing diagram illustrating input signals and node signals of the pixel P of FIG. 1 in the third period P3 of the display mode.

Referring to FIGS. 1 to 9, in the third period P3 of the display mode which is subsequent to the second period P2 of the display mode, the scan signal SC may have an inactive level, the sensing control signal SS may have the active level and the sweeping signal SW may have the inactive level.

The third period P3 of the display mode may be a holding period. The holding period may be a short waiting period prior to an increase of the sweeping signal SW. In the third period P3 of the display mode, the scan signal SC is inactivated so that the second transistor T2 and the fourth transistor T4 may be turned off.

The turn-on state of the first transistor T1 may be maintained by the voltage of the first node NA and the fifth transistor T5 may be turned on in response to the sensing control signal SS. The fifth transistor T5 is turned on so that the light emitting element EE may not be turned on yet.

In addition, the grayscale data voltage DG applied to the second node NB may vary according to a grayscale value, but the grayscale data voltage DG may not be quite high enough to turn on the third transistor T3 regardless of the grayscale value. Thus, the third transistor T3 may be turned off in the third period P3 of the display mode.

Figure 10:
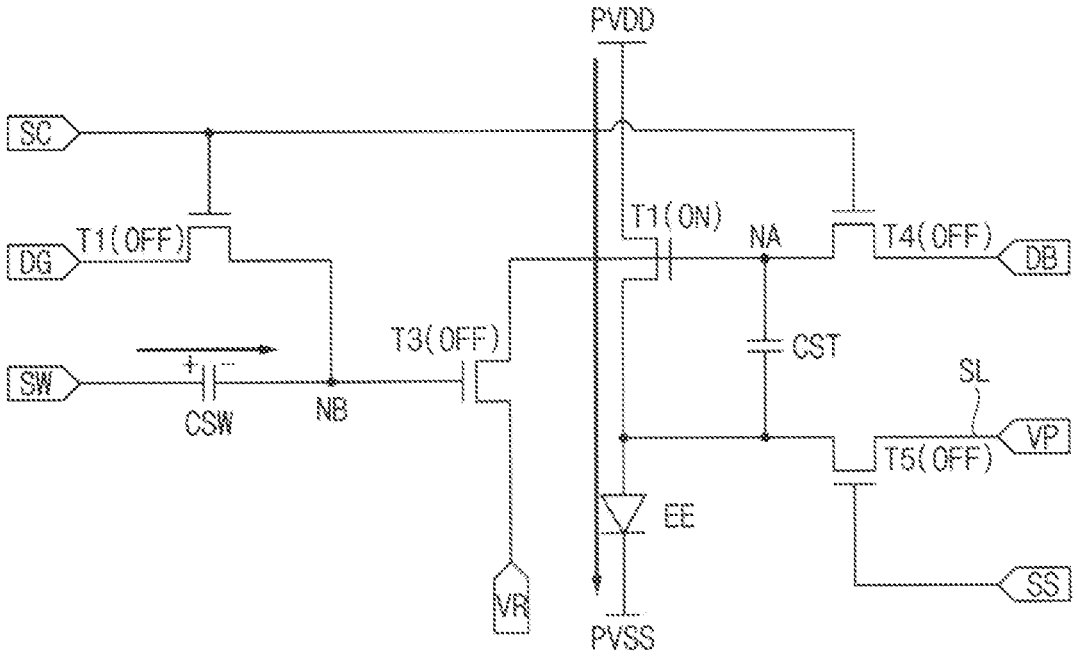
FIG. 10 is a circuit diagram illustrating the pixel of FIG. 1 in a fourth period of the display mode.
Figure 11:
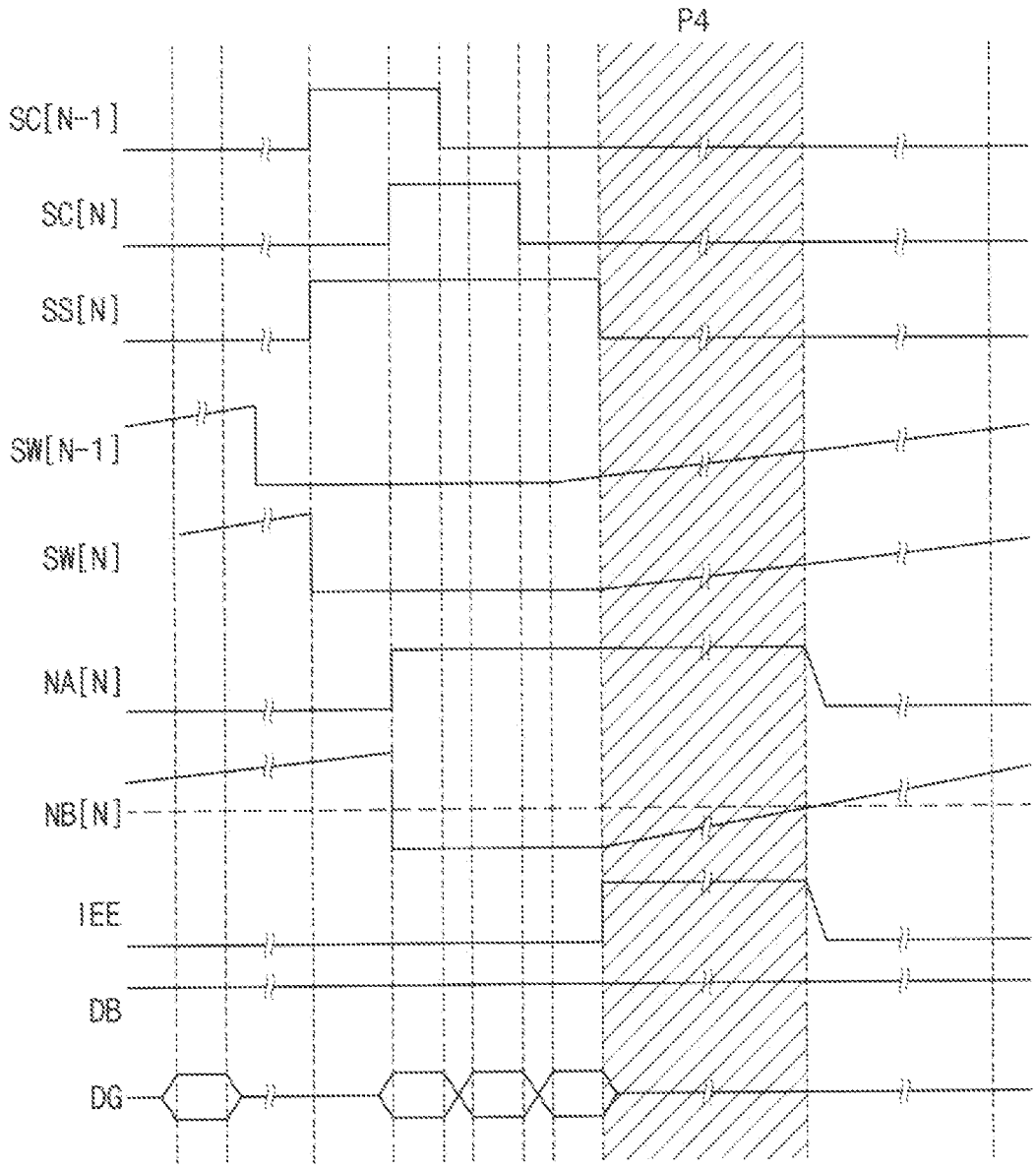
FIG. 11 is a timing diagram illustrating input signals and node signals of the pixel of FIG. 1 in the fourth period of the display mode.

FIG. 10 is a circuit diagram illustrating the pixel P of FIG. 1 in a fourth period P4 of the display mode. FIG. 11 is a timing diagram illustrating input signals and node signals of the pixel P of FIG. 1 in the fourth period P4 of the display mode.

Referring to FIGS. 1 to 11, in the fourth period P4 of the display mode which is subsequent to the third period P3 of the display mode, the scan signal SC may have the inactive level, the sensing control signal SS may have an inactive level and the sweeping signal SW may gradually increase, the first transistor T1 may be turned on and the third transistor T3 may be turned off so that the light emitting element EE may emit a light.

The fourth period P4 of the display mode may be a sweeping emission period. In the fourth period P4 of the display mode, the scan signal SC is inactivated so that the second transistor T2 and the fourth transistor T4 may be turned off. In addition, the sensing control signal SS is inactivated so that the fifth transistor T5 may be turned off.

In the fourth period P4 of the display mode, the sweeping signal SW may be gradually increased. When the sweeping signal SW is gradually increased, the voltage of the second node NB may be gradually increased by the sweeping capacitor CSW. The third transistor T3 is not turned on until the voltage of the second node NB reaches a threshold value. When the third transistor T3 is not turned on, the current may be flow through the first transistor T1 and the light emitting element EE. Thus, the light emitting element EE emits a light by the current IEE flowing through the light emitting element EE.

Figure 12:
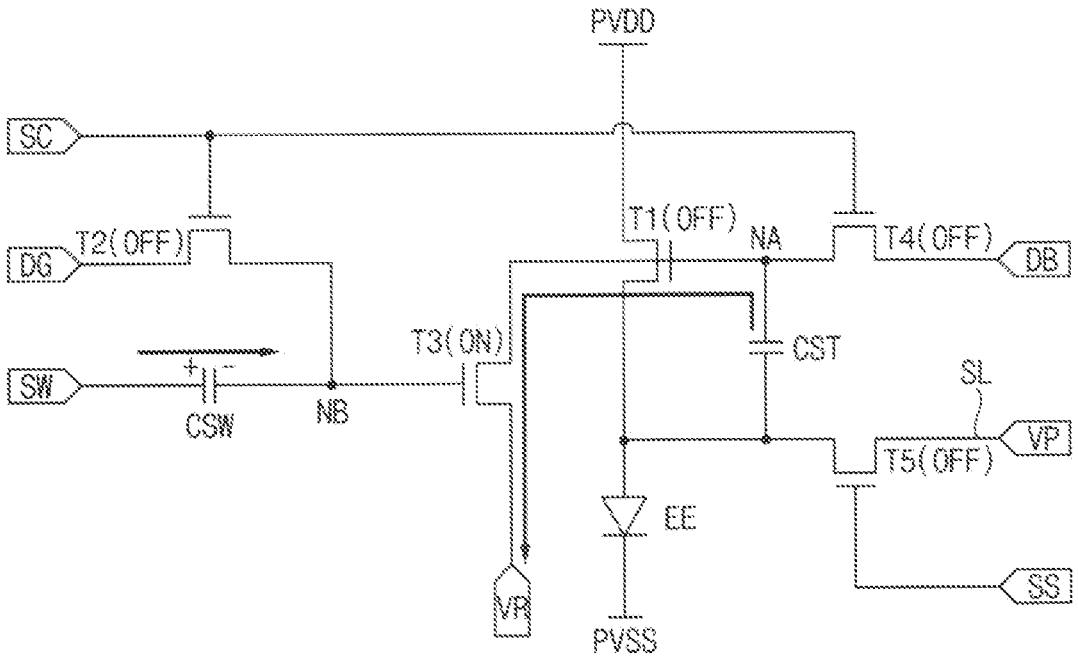
FIG. 12 is a circuit diagram illustrating the pixel of FIG. 1 in a fifth period of the display mode.
Figure 13:
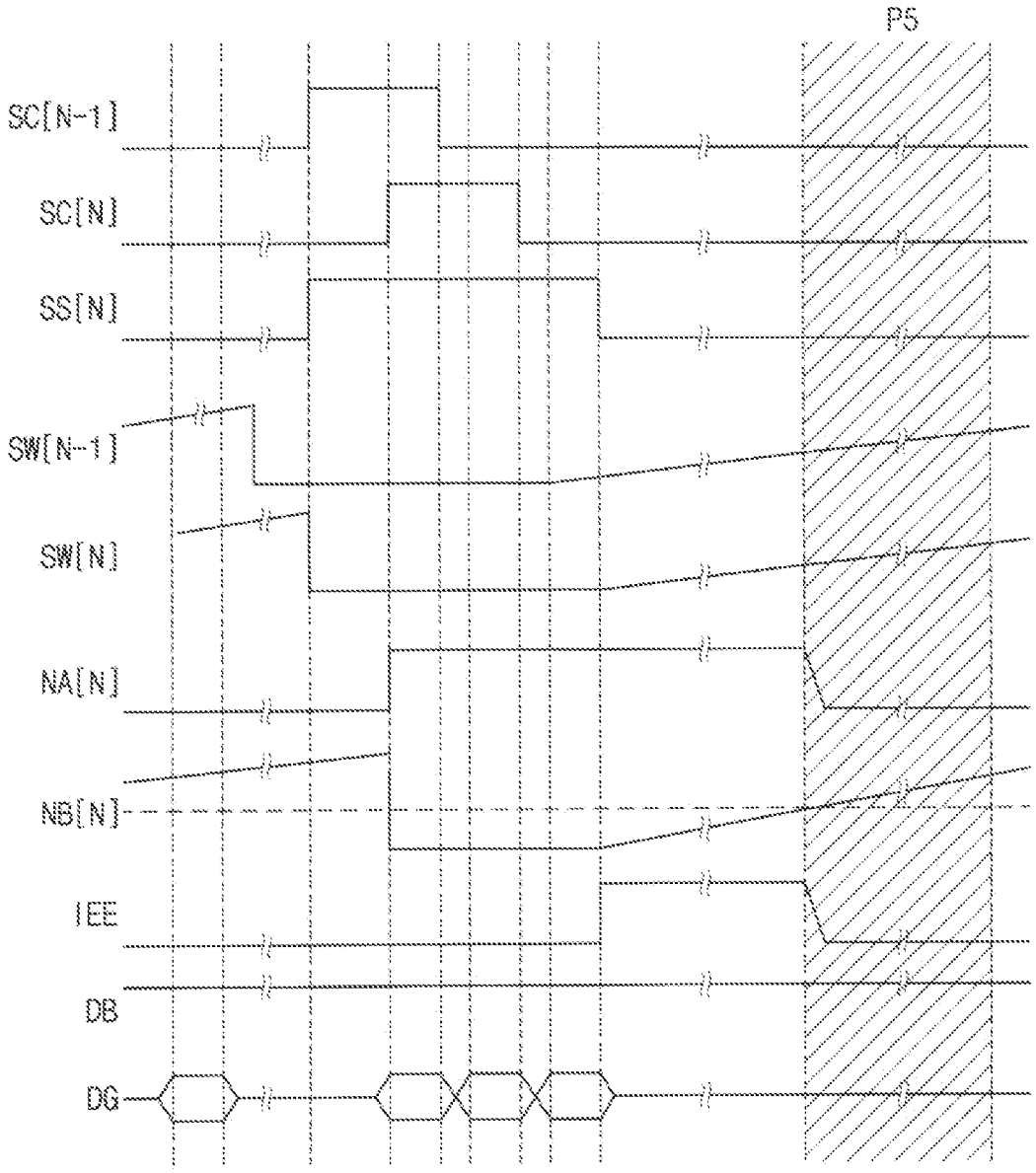
FIG. 13 is a timing diagram illustrating input signals and node signals of the pixel of FIG. 1 in the fifth period of the display mode.

FIG. 12 is a circuit diagram illustrating the pixel P of FIG. 1 in a fifth period P5 of the display mode. FIG. 13 is a timing diagram illustrating input signals and node signals of the pixel P of FIG. 1 in the fifth period P5 of the display mode.

Referring to FIGS. 1 to 13, in the fifth period P5 of the display mode which is subsequent to the fourth period P4 of the display mode, the scan signal SC may have the inactive level, the sensing control signal SS may have the inactive level and the sweeping signal SW may gradually increase, the third transistor T3 may be turned on and the first transistor T1 may be turned off so that the light emitting element EE may not emit a light.

The fifth period P5 of the display mode may be a sweeping non-emission period. In the fifth period P5 of the display mode, the scan signal SC is inactivated so that the second transistor T2 and the fourth transistor T4 may be turned off. In addition, the sensing control signal SS is inactivated so that the fifth transistor T5 may be turned off.

Following the fourth period P4 of the display mode, the sweeping signal SW may be continuously increased in the fifth period P5 as well. When the sweeping signal SW is gradually increased, the voltage of the second node NB may be gradually increased by the sweeping capacitor CSW. When the second node NB exceeds a threshold value, the third transistor T3 is turned on. When the third transistor T3 is turned on, the reference voltage VR having a lower level is applied to the first node NA which is connected to the control electrode of the first transistor T1. For example, the reference voltage VR may be a direct current (DC) voltage to turn off the first transistor T1.

When the reference voltage VR having the lower level is applied to the first node NA, the first transistor T1 is turned off so that the current may not flow to the light emitting element EE. Thus, in the fifth period P5 of the display mode, the light emitting element EE does not emit a light.

Figure 14:
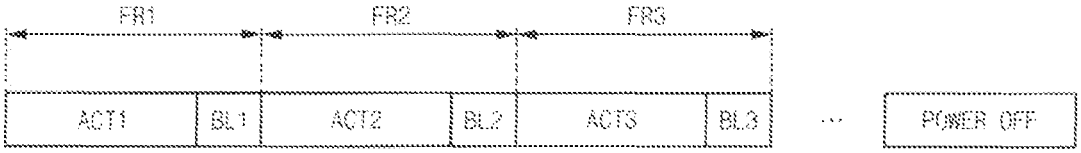
FIG. 14 is a conceptual diagram illustrating a driving timing of a display panel of FIG. 1.

FIG. 14 is a conceptual diagram illustrating a driving timing of the display panel 100 of FIG. 1.

Referring to FIGS. 1 to 14, the display panel 100 may be driven in a unit of a frame. The frame may include an active period and a vertical blank period. In the active period, the grayscale data voltage DG may be sequentially written to the pixels P. In the vertical blank period, the grayscale data voltage DG may not be written to the pixels P.

For example, a first frame FR1 may include a first active period AC1 and a first blank period BL1. For example, a second frame FR2 may include a second active period AC2 and a second blank period BL2. For example, a third frame FR3 may include a third active period AC3 and a third blank period BL3.

A duration when the display apparatus is turned off may be referred to a power off duration POWER OFF. In the power off duration POWER OFF, a driving operation to turn off the display apparatus may be operated.

In the vertical blank period BL1, BL2 and BL3 and the power off duration POWER OFF, a sensing operation to determine the characteristics of the transistors of the pixel P may be operated.

In an embodiment, the first sensing mode to sense the threshold voltage of the first transistor T1 may be operated in the vertical blank period BL1, BL2 and BL3. The second sensing mode to sense the threshold voltage of the third transistor T3 may be operated in the power off duration POWER OFF.

The driving controller 200 may compensate the deviation of the threshold voltages of the first transistors T1 of the pixels P and the deviation of the threshold voltages of the third transistors T3 of the pixels P.

The deviation of the threshold voltages of the first transistors T1 may have a relatively greater influence on the display quality of the display panel 100 than the deviation of the threshold voltages of the third transistors T3 so that the deviation of the threshold voltages of the first transistors T1 may be compensated in every frame (e.g. in every vertical blank period).

In an embodiment, the first sensing mode to sense the threshold voltage of the first transistor T1 may be operated in the vertical blank period BL1, BL2 and BL3. Both of the first sensing mode to sense the threshold voltage of the first transistor T1 and the second sensing mode to sense the threshold voltage of the third transistor T3 may be operated in the power off duration POWER OFF. Since the power off duration POWER OFF has a relatively long time, the characteristics of both the first transistor T1 and the third transistor T3 may be determined in the power off duration POWER OFF.

In an embodiment, when a time margin of the vertical blank period BL1, BL2, and BL3 is allowed, both of the first sensing mode to sense the threshold voltage of the first transistor T1 and the second sensing mode to sense the threshold voltage of the third transistor T3 may be operated in the vertical blank period BL1, BL2, and BL3.

Figure 15:
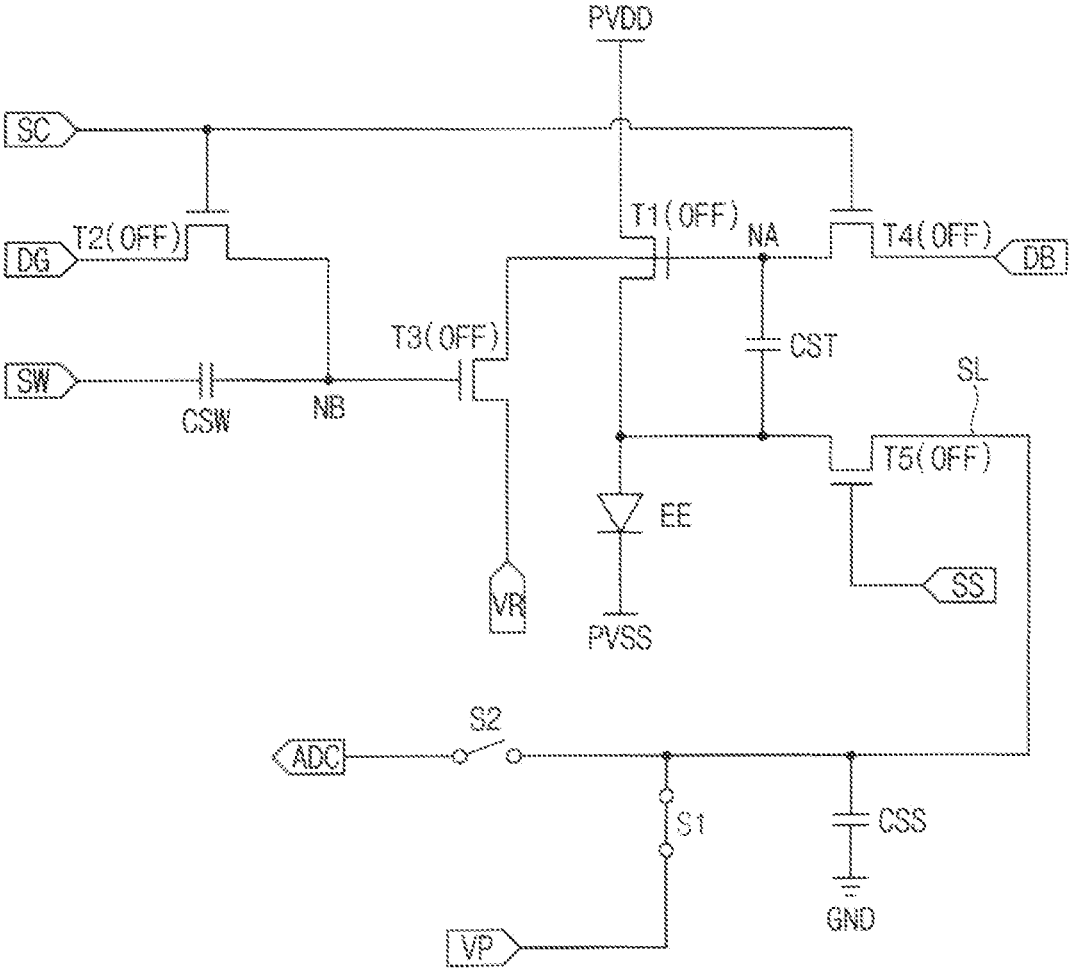
FIG. 15 is a circuit diagram illustrating the pixel of FIG. 1 in a first period of a first sensing mode.
Figure 16:
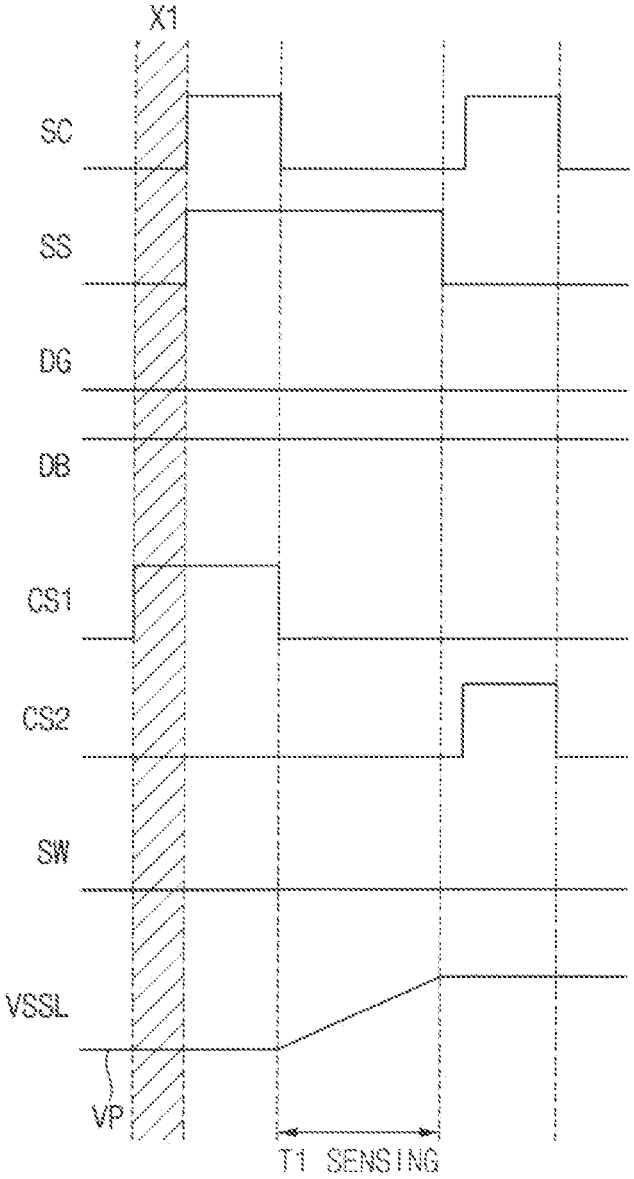
FIG. 16 is a timing diagram illustrating input signals and output signals of the pixel of FIG. 1 in the first period of the first sensing mode.
Figure 17:
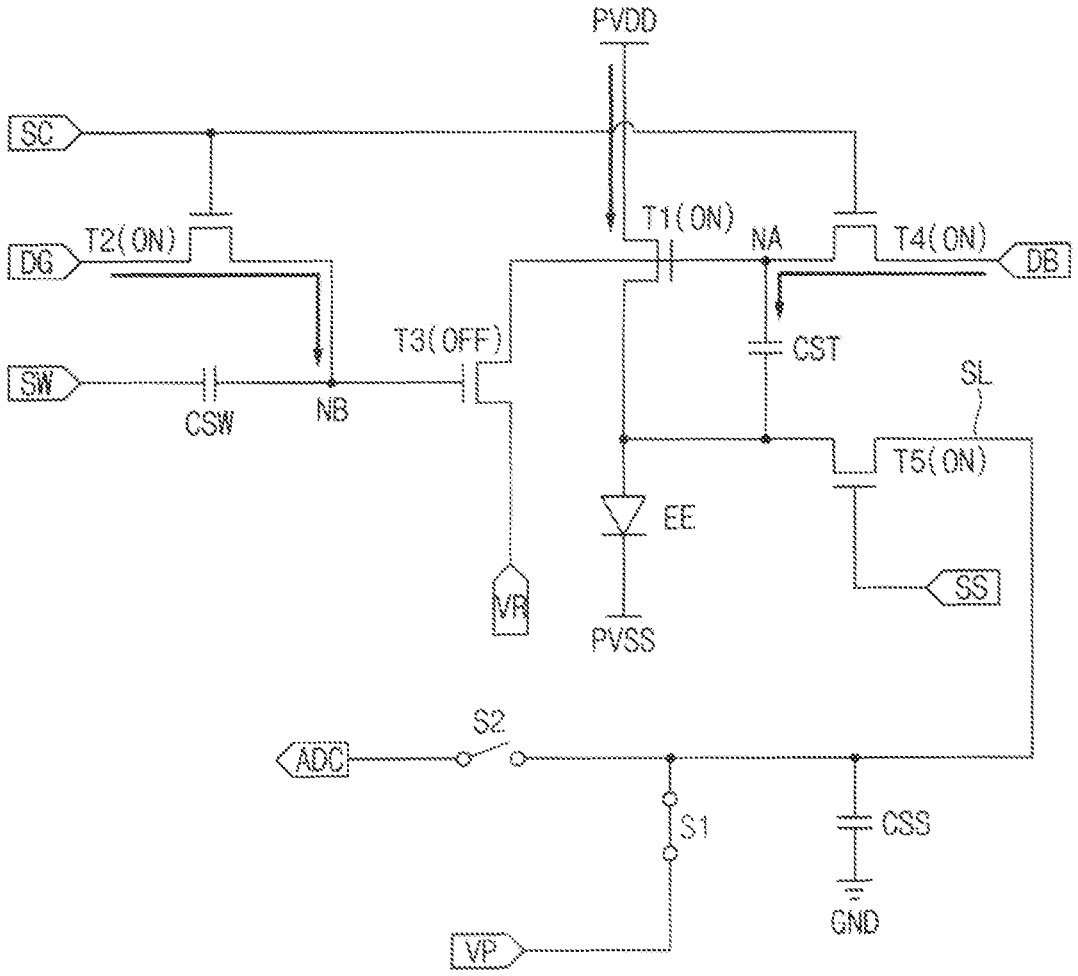
FIG. 17 is a circuit diagram illustrating the pixel of FIG. 1 in a second period of the first sensing mode.
Figure 18:
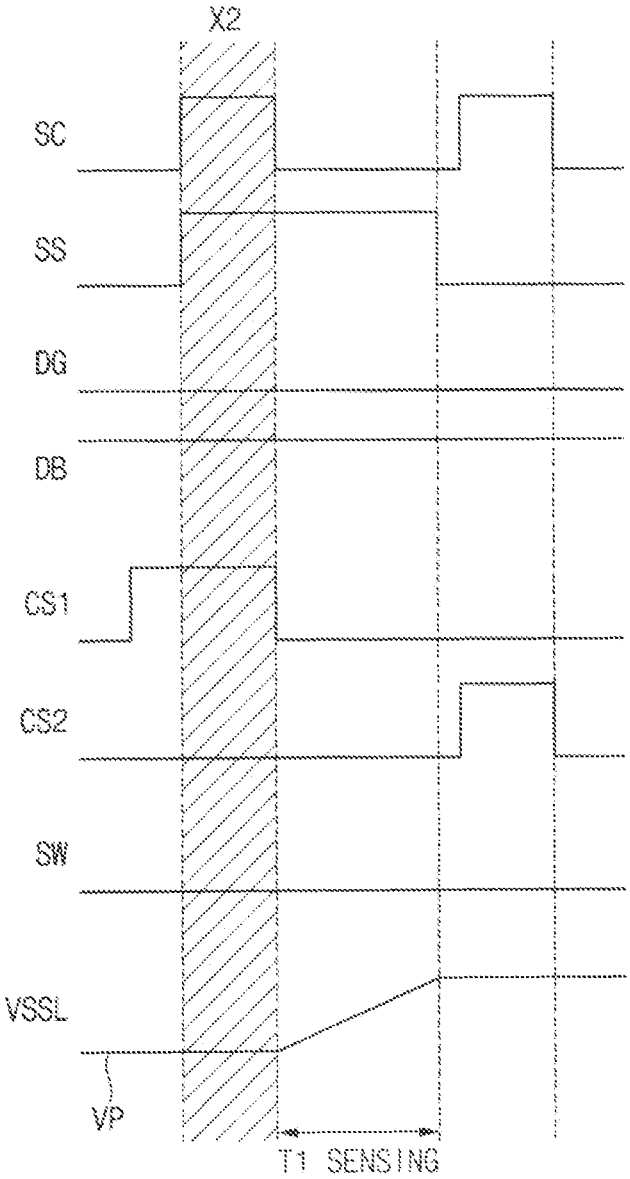
FIG. 18 is a timing diagram illustrating input signals and output signals of the pixel of FIG. 1 in the second period of the first sensing mode.
Figure 19:
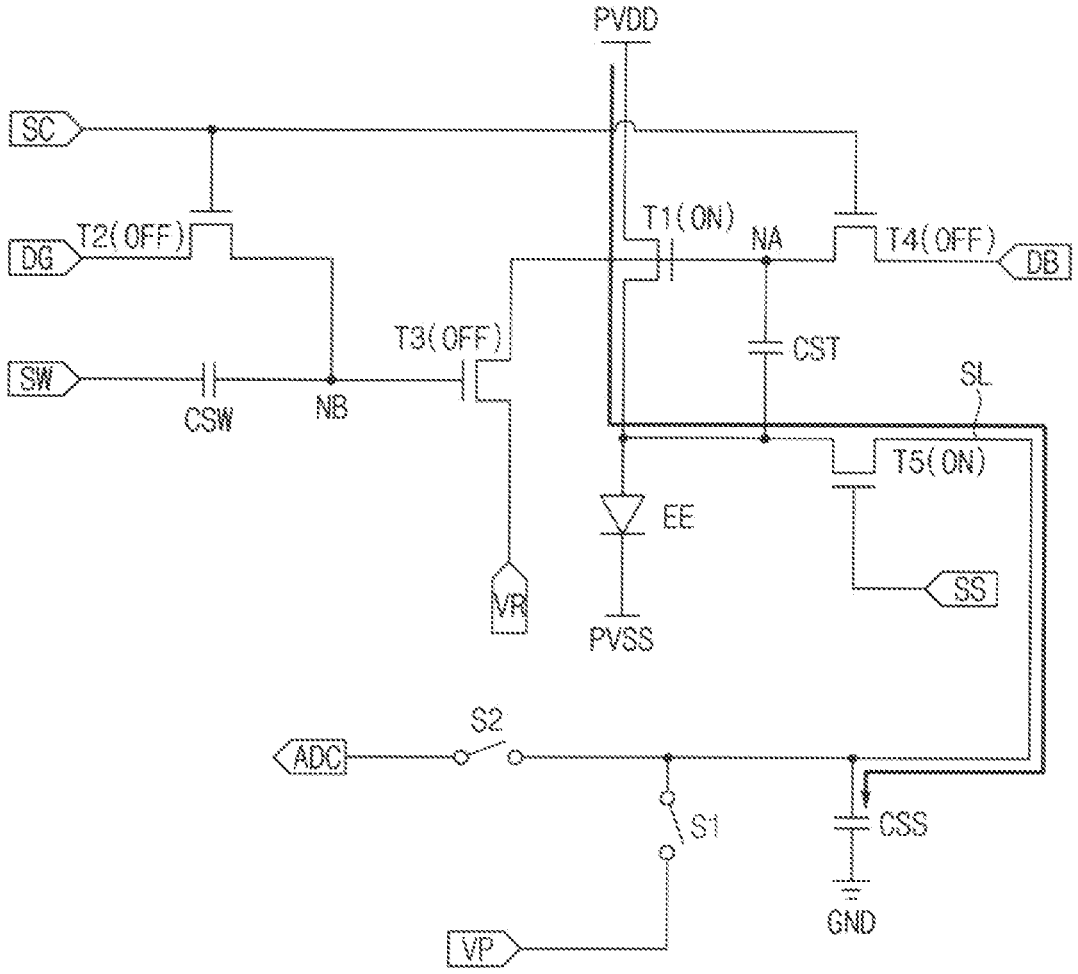
FIG. 19 is a circuit diagram illustrating the pixel of FIG. 1 in a third period of the first sensing mode.
Figure 20:
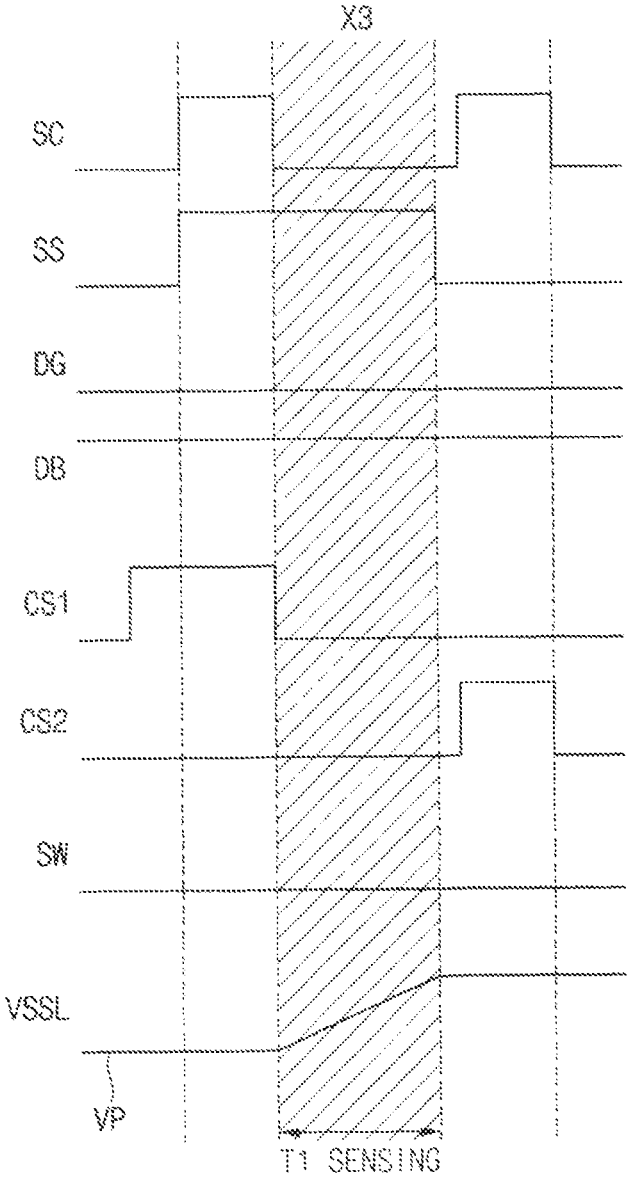
FIG. 20 is a timing diagram illustrating input signals and output signals of the pixel of FIG. 1 in the third period of the first sensing mode.
Figure 21:
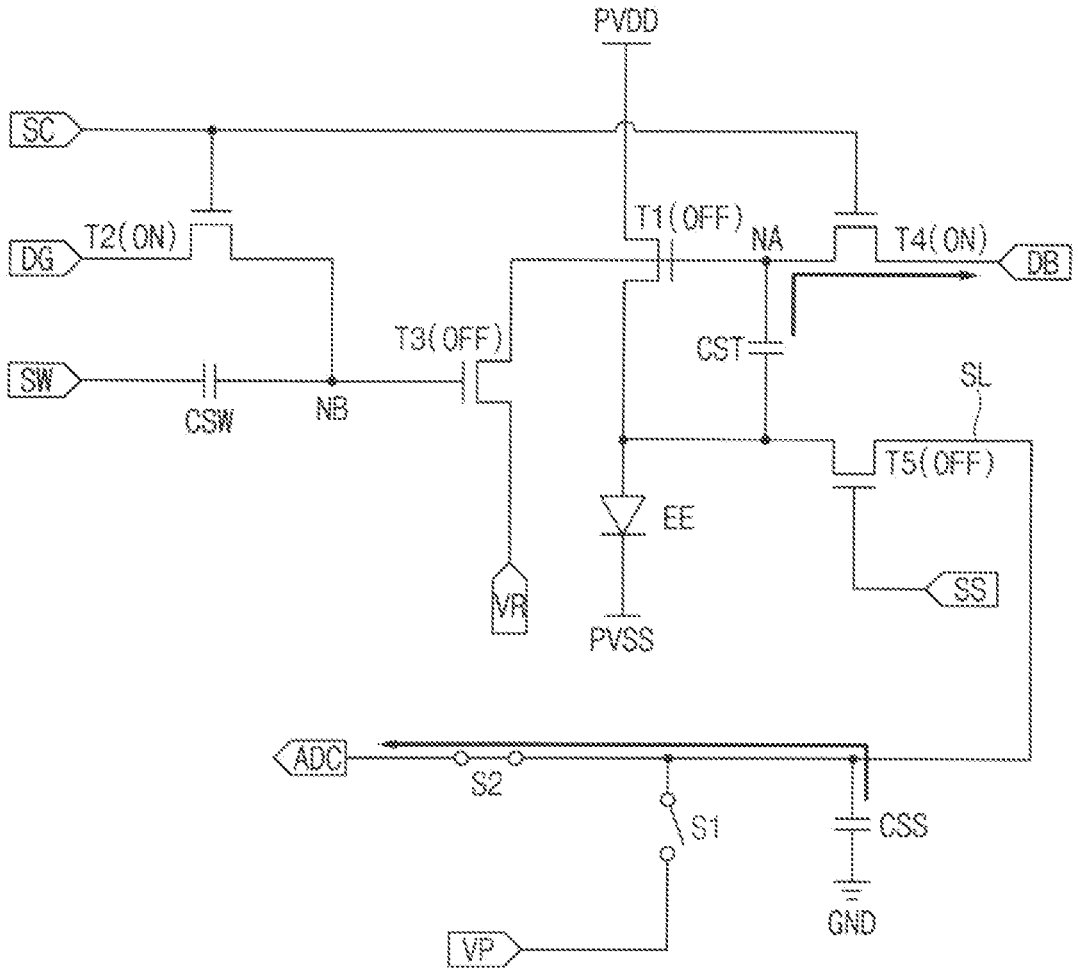
FIG. 21 is a circuit diagram illustrating the pixel of FIG. 1 in a fourth period of the first sensing mode.
Figure 22:
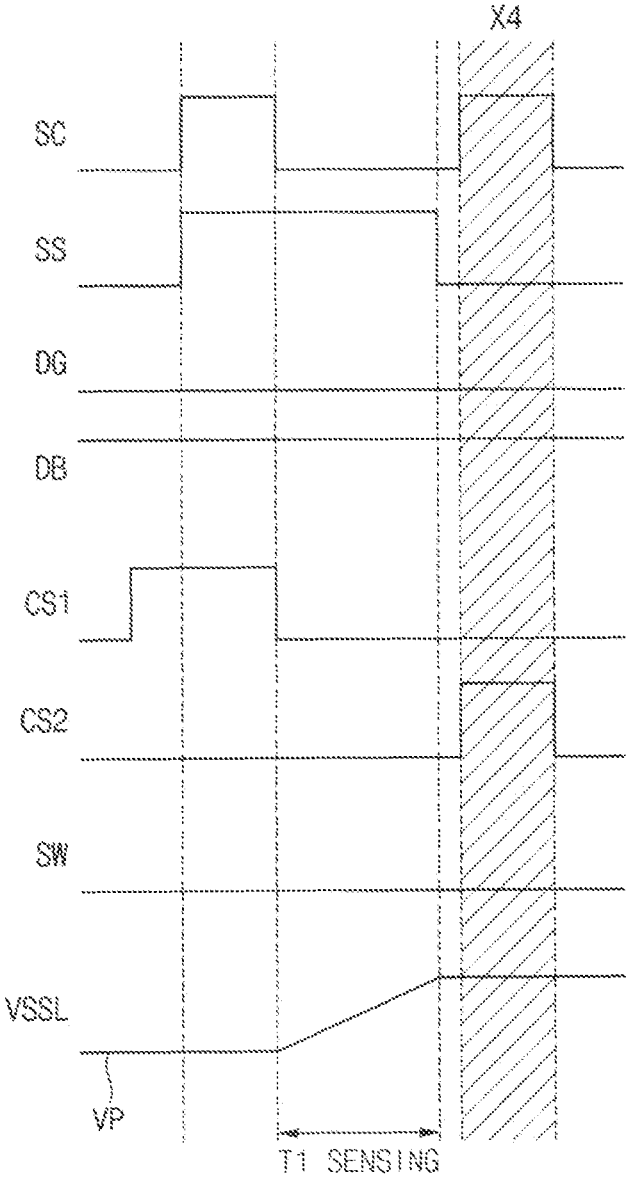
FIG. 22 is a timing diagram illustrating input signals and output signals of the pixel of FIG. 1 in the fourth period of the first sensing mode.

FIG. 15 is a circuit diagram illustrating the pixel P of FIG. 1 in a first period X1 of the first sensing mode. FIG. 16 is a timing diagram illustrating input signals and output signals of the pixel P of FIG. 1 in the first period X1 of the first sensing mode. FIG. 17 is a circuit diagram illustrating the pixel P of FIG. 1 in a second period X2 of the first sensing mode. FIG. 18 is a timing diagram illustrating input signals and output signals of the pixel P of FIG. 1 in the second period X2 of the first sensing mode. FIG. 19 is a circuit diagram illustrating the pixel P of FIG. 1 in a third period X3 of the first sensing mode. FIG. 20 is a timing diagram illustrating input signals and output signals of the pixel P of FIG. 1 in the third period X3 of the first sensing mode. FIG. 21 is a circuit diagram illustrating the pixel P of FIG. 1 in a fourth period X4 of the first sensing mode. FIG. 22 is a timing diagram illustrating input signals and output signals of the pixel P of FIG. 1 in the fourth period X4 of the first sensing mode.

Referring to FIGS. 1 to 22, the display apparatus may further include a first switch S1 including a first end portion connected to the input electrode of the fifth transistor T5 and a second end portion receiving the initialization voltage VP, a second switch S2 including a first end portion connected to the input electrode of the fifth transistor T5 and a second end portion connected to an analog to digital converter ADC and a sensing capacitor CSS connected to the input electrode of the fifth transistor T5.

For example, a first end portion of the sensing capacitor CSS may be connected to the input electrode of the fifth transistor T5 and a second end portion of the sensing capacitor CSS may be connected to a ground. For example, the sensing capacitor CSS may not be formed as an additional capacitor element but be formed by the capacitance of sensing line SL.

As shown in FIGS. 15 and 16, in a first period X1 of the first sensing mode to sense the characteristic of the first transistor T1, the scan signal SC may have the inactive level, the sensing control signal SS may have the inactive level, a first switch control signal CS1 applied to the first switch S1 may have an active level and a second switch control signal CS2 applied to the second switch S2 may have an inactive level.

In the first period X1 of the first sensing mode, all of the first to fifth transistors T1 to T5 may be turned off.

In the first period X1 of the first sensing mode, the first switch S1 may be turned on, the second switch S2 may be turned off, the initialization voltage VP may be applied to the input electrode of the fifth transistor T5 and the first end portion of the sensing capacitor CSS by the first switch S1.

As shown in FIGS. 17 and 18, in a second period X2 of the first sensing mode subsequent to the first period X1 of the first sensing mode, the scan signal SC may have the active level, the sensing control signal SS may have the active level, the first switch control signal CS1 may have an active level and the second switch control signal CS2 may have an inactive level.

In the second period X2 of the first sensing mode, the first, second, fourth and fifth transistors T1, T2, T4 and T5 may be turned on and the third transistor T3 may be turned off.

In the second period X2 of the first sensing mode, the first switch S1 may be turned on and the second switch S2 may be turned off.

In the second period X2 of the first sensing mode, a bias operation of the first transistor T1 may be operated. In the second period X2 of the first sensing mode, the bias data voltage DB having a higher level may be written to the first node NA, the grayscale data voltage DG having a lower level may be written to the second node NB and the first power voltage PVDD may be applied to the input electrode of the first transistor T1.

For example, the bias data voltage DB may be a direct current (DC) voltage to turn on the first transistor T1 in the first sensing mode. For example, the grayscale data voltage DG may be a direct current (DC) voltage to turn on the third transistor T3 in the first sensing mode. The grayscale data voltage DG may have a value corresponding to the grayscale in the display mode, but the grayscale data voltage DG may have a predetermined DC voltage in the first sensing mode.

As shown in FIGS. 19 and 20, in a third period X3 of the first sensing mode subsequent to the second period X2 of the first sensing mode, the scan signal SC may have the inactive level, the sensing control signal SS may have the active level, the first switch control signal CS1 may have an inactive level, the second switch control signal CS2 may have the inactive level and a first sensing voltage VSSL may be gradually charged to the sensing capacitor CSS.

In the third period X3 of the first sensing mode, the first and fifth transistors T1 and T5 may be turned on and the second, third and fourth transistors T2, T3 and T4 may be turned off.

In the third period X3 of the first sensing mode, the first switch S1 may be turned off and the second switch S2 may be turned off.

In the third period X3 of the first sensing mode, the current flows from the first transistor T1 to the sensing capacitor CSS so that the first sensing voltage VSSL may be gradually charged at the sensing capacitor CSS.

As shown in FIGS. 21 and 22, in a fourth period X4 of the first sensing mode subsequent to the third period X3 of the first sensing mode, the scan signal SC may have the active level, the sensing control signal SS may have the inactive level, the first switch control signal CS1 may have the inactive level, the second switch control signal CS2 may have an active level and the first sensing voltage VSSL may be outputted from the sensing capacitor CSS to the analog to digital converter ADC.

In the fourth period X4 of the first sensing mode, the second and fourth transistors T2 and T4 may be turned on and the first, third and fifth transistors T1, T3 and T5 may be turned off.

In the fourth period X4 of the first sensing mode, the first switch S1 may be turned off and the second switch S2 may be turned on.

In the fourth period X4 of the first sensing mode, the first switch S1 may be turned off and the second switch S2 may be turned on so that the first sensing voltage VSSL may be outputted from the sensing capacitor CSS to the analog to digital converter ADC and the characteristic of the first transistor T1 may be sensed.

Figure 23:
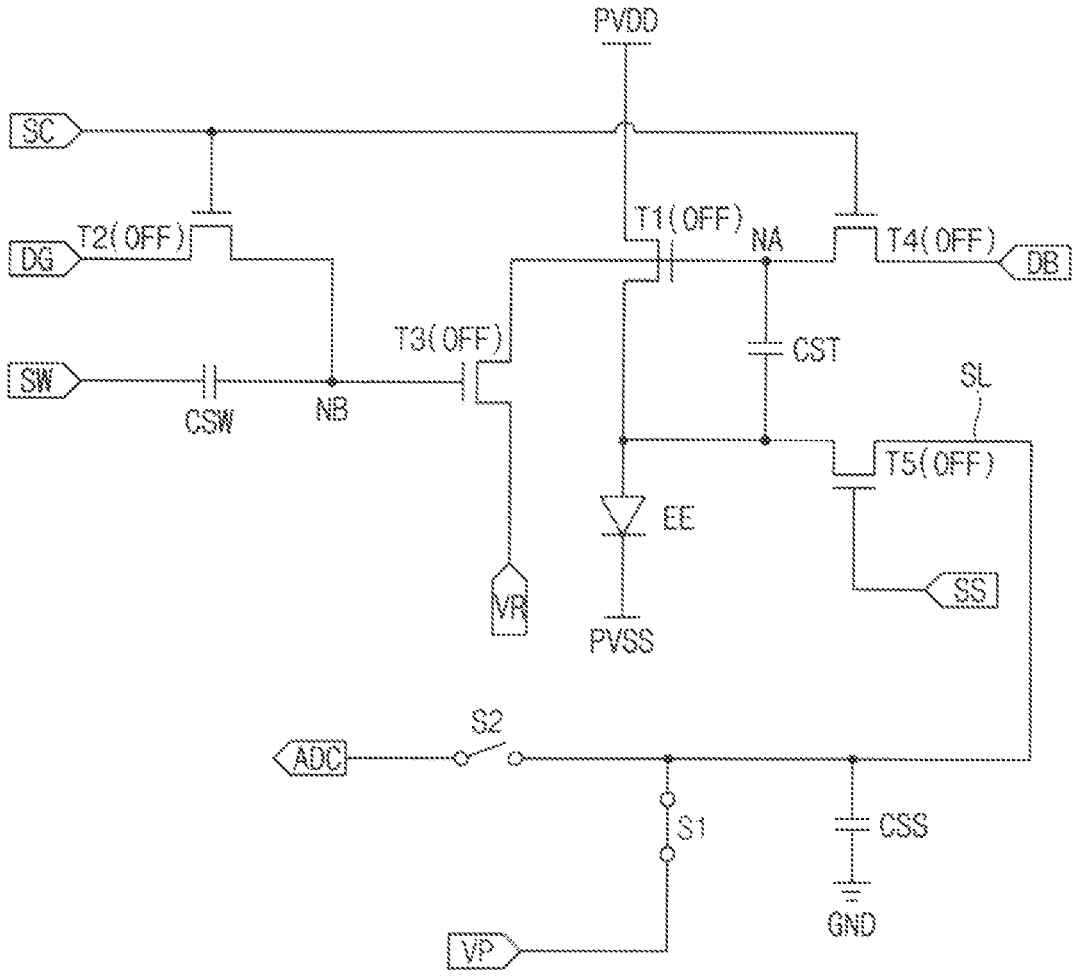
FIG. 23 is a circuit diagram illustrating the pixel of FIG. 1 in a first period of a second sensing mode.
Figure 24:
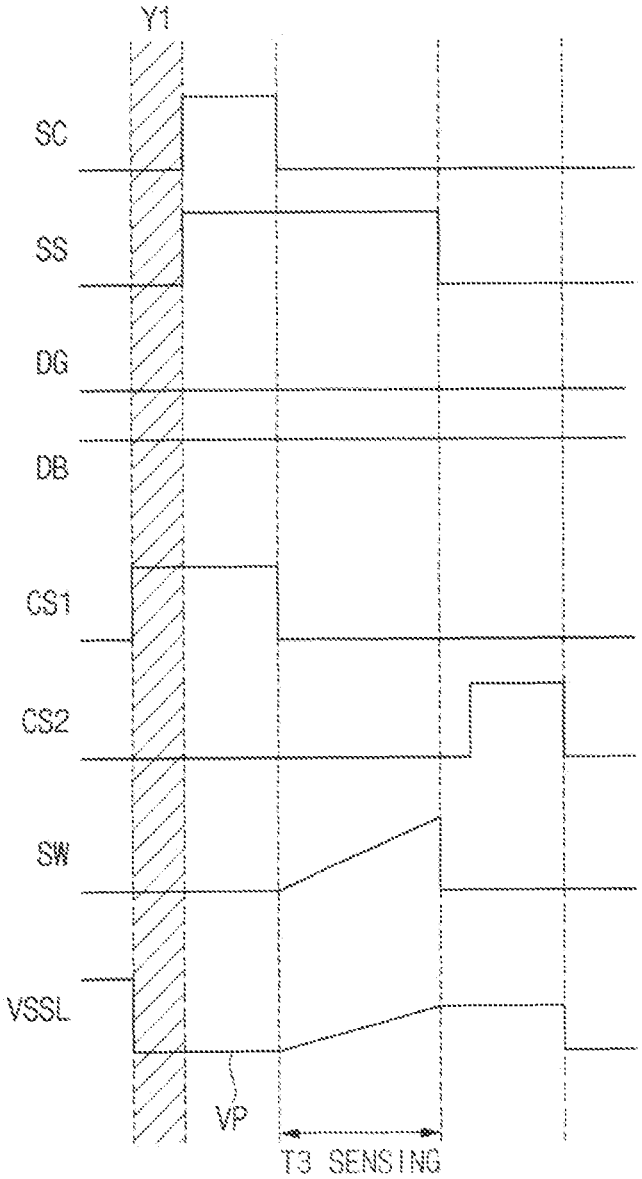
FIG. 24 is a timing diagram illustrating input signals and output signals of the pixel of FIG. 1 in the first period of the second sensing mode.
Figure 25:
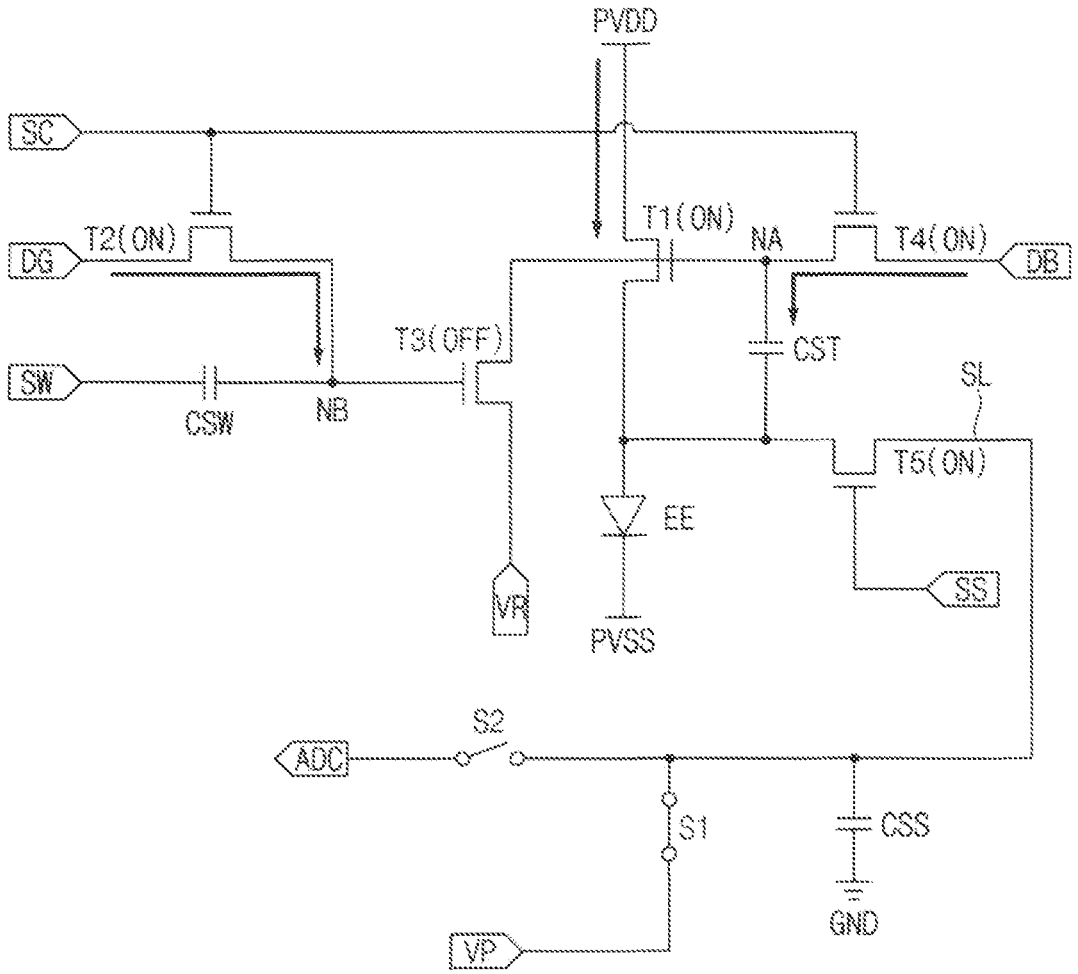
FIG. 25 is a circuit diagram illustrating the pixel of FIG. 1 in a second period of the second sensing mode.
Figure 26:
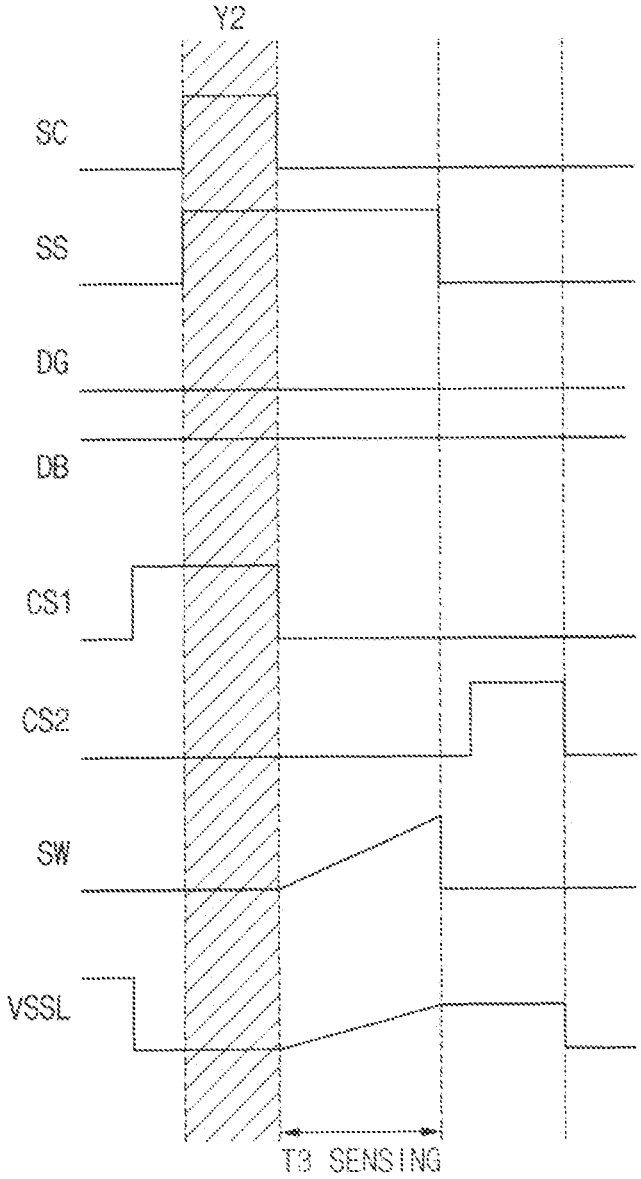
FIG. 26 is a timing diagram illustrating input signals and output signals of the pixel of FIG. 1 in the second period of the second sensing mode.
Figure 27:
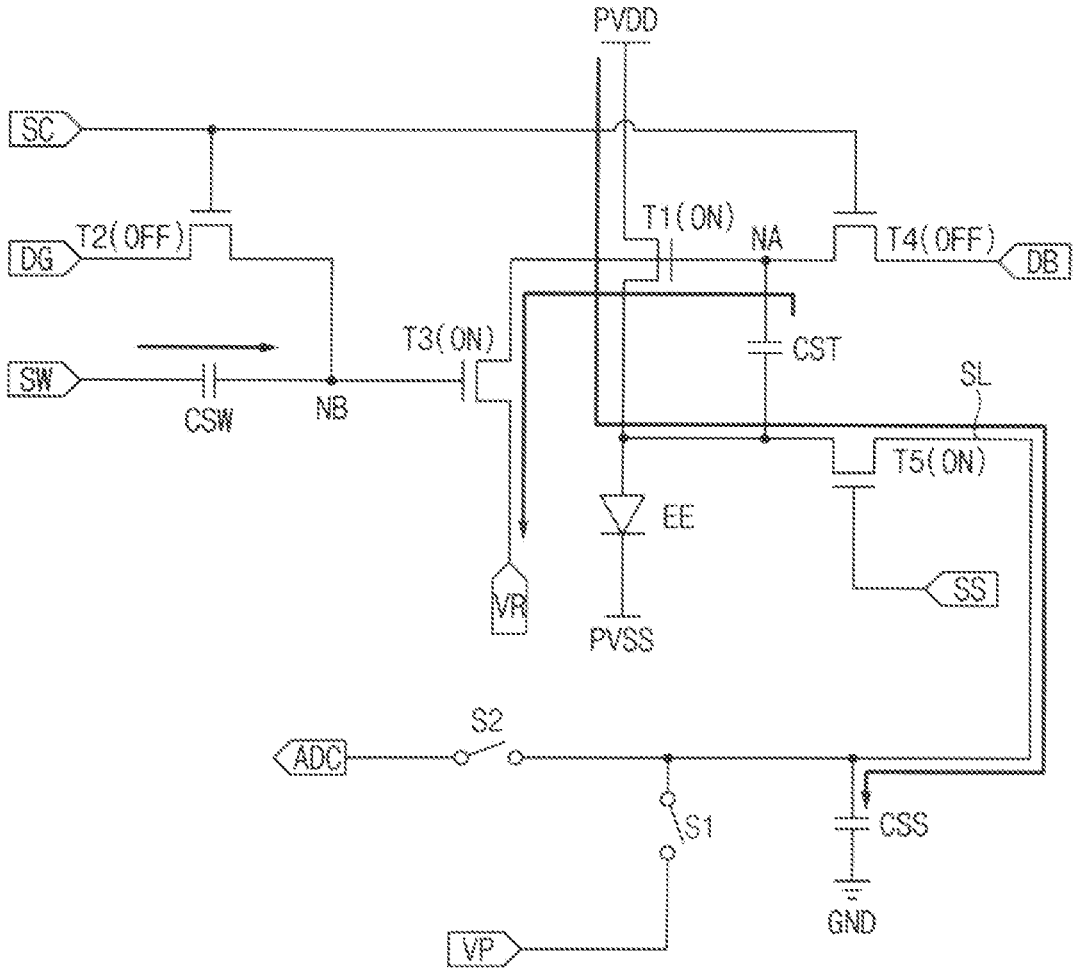
FIG. 27 is a circuit diagram illustrating the pixel of FIG. 1 in a third period of the second sensing mode.
Figure 28:
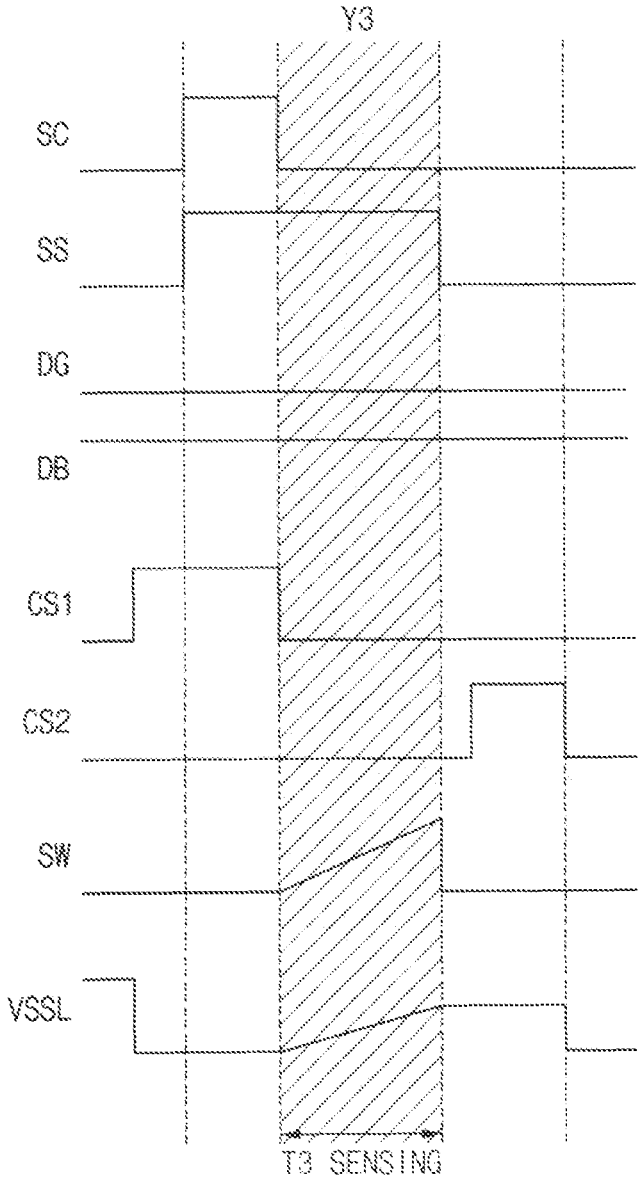
FIG. 28 is a timing diagram illustrating input signals and output signals of the pixel of FIG. 1 in the third period of the second sensing mode.
Figure 29:
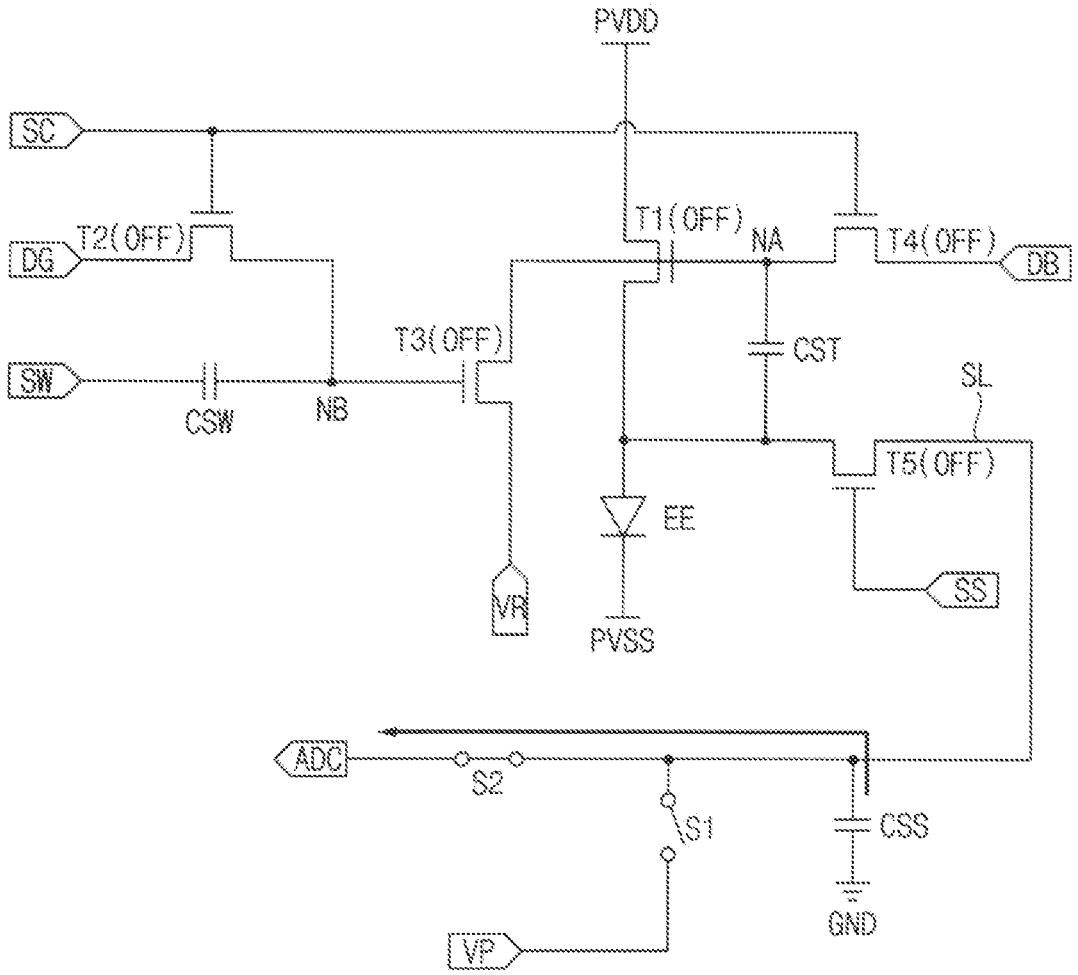
FIG. 29 is a circuit diagram illustrating the pixel of FIG. 1 in a fourth period of the second sensing mode.
Figure 30:
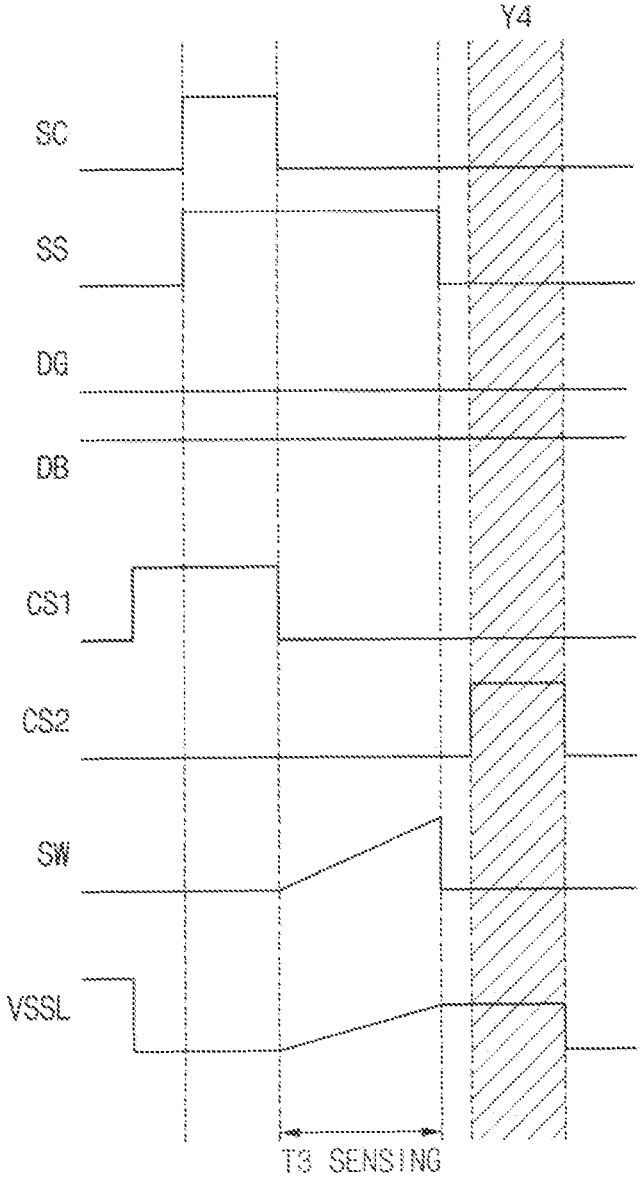
FIG. 30 is a timing diagram illustrating input signals and output signals of the pixel of FIG. 1 in the fourth period of the second sensing mode.

FIG. 23 is a circuit diagram illustrating the pixel P of FIG. 1 in a first period Y1 of a second sensing mode. FIG. 24 is a timing diagram illustrating input signals and output signals of the pixel P of FIG. 1 in the first period Y1 of the second sensing mode. FIG. 25 is a circuit diagram illustrating the pixel P of FIG. 1 in a second period Y2 of the second sensing mode. FIG. 26 is a timing diagram illustrating input signals and output signals of the pixel P of FIG. 1 in the second period Y2 of the second sensing mode. FIG. 27 is a circuit diagram illustrating the pixel P of FIG. 1 in a third period Y3 of the second sensing mode. FIG. 28 is a timing diagram illustrating input signals and output signals of the pixel P of FIG. 1 in the third period Y3 of the second sensing mode. FIG. 29 is a circuit diagram illustrating the pixel P of FIG. 1 in a fourth period Y4 of the second sensing mode. FIG. 30 is a timing diagram illustrating input signals and output signals of the pixel P of FIG. 1 in the fourth period Y4 of the second sensing mode.

As shown in FIGS. 23 and 24, in a first period Y1 of the second sensing mode to sense the characteristic of the third transistor T3, the scan signal SC may have the inactive level, the sensing control signal SS may have the inactive level, the first switch control signal CS1 applied to the first switch S1 may have the active level and the second switch control signal CS2 applied to the second switch S2 may have the inactive level.

In the first period Y1 of the second sensing mode, all of the first to fifth transistors T1 to T5 may be turned off.

In the first period Y1 of the second sensing mode, the first switch S1 may be turned on, the second switch S2 may be turned off, the initialization voltage VP may be applied to the input electrode of the fifth transistor T5 and the first end portion of the sensing capacitor CSS by the first switch S1.

As shown in FIGS. 25 and 26, in a second period Y2 of the second sensing mode subsequent to the first period Y1 of the second sensing mode, the scan signal SC may have the active level, the sensing control signal SS may have the active level, the first switch control signal CS1 may have an active level and the second switch control signal CS2 may have an inactive level.

In the second period Y2 of the second sensing mode, the first, second, fourth and fifth transistors T1, T2, T4 and T5 may be turned on and the third transistor T3 may be turned off.

In the second period Y2 of the second sensing mode, the first switch S1 may be turned on and the second switch S2 may be turned off.

In the second period Y2 of the second sensing mode, a bias operation of the first transistor T1 may be operated. In the second period Y2 of the second sensing mode, the bias data voltage DB having a higher level may be written to the first node NA, the grayscale data voltage DG having a lower level may be written to the second node NB and the first power voltage PVDD may be applied to the input electrode of the first transistor T1.

For example, the bias data voltage DB may be a direct current (DC) voltage to turn on the first transistor T1 in the second sensing mode. For example, the grayscale data voltage DG may be a direct current (DC) voltage to turn on the third transistor T3 in the second sensing mode. The grayscale data voltage DG may have a value corresponding to the grayscale in the display mode, but the grayscale data voltage DG may have a predetermined DC voltage in the second sensing mode.

As shown in FIGS. 27 and 28, in a third period Y3 of the second sensing mode subsequent to the second period Y2 of the second sensing mode, the scan signal SC may have the inactive level, the sensing control signal SS may have the active level, the first switch control signal CS1 may have the inactive level, the second switch control signal CS2 may have the inactive level, the sweeping signal SW may be gradually increased and a second sensing voltage VSSL may be gradually charged to the sensing capacitor CSS.

In the third period Y3 of the second sensing mode, the first, third and fifth transistors T1, T3 and T5 may be turned on and the second and fourth transistors T2 and T4 may be turned off.

In the third period Y3 of the second sensing mode, the first switch S1 may be turned off and the second switch S2 may be turned off.

In the third period Y3 of the second sensing mode, the current may flow from the first transistor T1 to the sensing capacitor CSS by the operations of the turned on first transistor T1 and the third transistor T3 so that the second sensing voltage VSSL may be gradually charged at the sensing capacitor CSS. The second sensing voltage VSSL charged at the sensing capacitor CSS may correspond to the threshold voltage of the third transistor T3.

As shown in FIGS. 29 and 30, in a fourth period Y4 of the second sensing mode subsequent to the third period Y3 of the second sensing mode, the scan signal SC may have the inactive level, the sensing control signal SS may have the inactive level, the first switch control signal CS1 may have the inactive level, the second switch control signal CS2 may have the active level and the second sensing voltage VSSL may be outputted from the sensing capacitor CSS to the analog to digital converter ADC.

In the fourth period Y4 of the second sensing mode, all of the first to fifth transistors T1 to T5 may be turned off.

In the fourth period Y4 of the second sensing mode, the first switch S1 may be turned off and the second switch S2 may be turned on.

In the fourth period Y4 of the second sensing mode, the first switch S1 may be turned off and the second switch S2 may be turned on so that the second sensing voltage VSSL may be outputted from the sensing capacitor CSS to the analog to digital converter ADC and the characteristic of the first transistor T1 may be sensed.

According to the present embodiment, the display apparatus including the light emitting diode as the light emitting element may display an image not in a pulse amplitude modulation method but in a pulse width modulation method. In the pulse width modulation method, the problem that the emission wavelength changed according to the amount of the current may be solved.

In addition, the display apparatus may display an image in a progressive emission method in which the horizontal lines have the different light emission timings so that the display panel 100 may be driven in a relatively lower driving voltage and accordingly the power consumption of the display apparatus may be reduced.

In addition, characteristics of the first transistors T1 of the pixels P and characteristics of the third transistors T3 of the pixels P may be sensed and the deviation of the characteristics of the first transistors T1 of the pixels P and the deviation of the characteristics of the third transistors T3 of the pixels P may be compensated so that the display quality of the display panel 100 may be enhanced.

According to the embodiments of the display apparatus, a power consumption of the display apparatus may be reduced and the display quality of the display panel may be enhanced.

The foregoing is illustrative of the present inventive concept and is not to be construed as limiting thereof. Although embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function.

What is claimed is:

1. A display apparatus comprising a pixel, the pixel comprising:

a first transistor including a control electrode electrically connected to a first node, an input electrode configured to receive a first power voltage and an output electrode electrically connected to a first electrode of a light emitting element;

a second transistor including a control electrode configured to receive a scan signal, an input electrode configured to receive a grayscale data voltage and an output electrode electrically connected to a second node;

a third transistor including a control electrode electrically connected to the second node, an input electrode configured to receive a reference voltage and an output electrode electrically connected to the first node;

a fourth transistor including a control electrode configured to receive the scan signal, an input electrode configured to receive a bias data voltage and an output electrode electrically connected to the first node;

a fifth transistor including a control electrode configured to receive a sensing control signal, an input electrode configured to receive an initialization voltage and an output electrode electrically connected to the first electrode of the light emitting element; and the light emitting element including the first electrode and a second electrode configured to receive a second power voltage.

2. The display apparatus of claim 1, wherein the pixel further comprises:

a storage capacitor including a first end portion electrically connected to the first node and a second end portion electrically connected to the first electrode of the light emitting element; and a sweeping capacitor including a first end portion configured to receive a sweeping signal and a second end portion electrically connected to the second node.

3. The display apparatus of claim 2, wherein, in a first period of a display mode in which the pixel is configured to display an image based on the grayscale data voltage, the scan signal has an active level, the sensing control signal has an active level, the sweeping signal has an inactive level and the grayscale data voltage is a precharge data voltage.

4. The display apparatus of claim 3, wherein, in a second period of the display mode subsequent to the first period of the display mode, the scan signal has the active level, the sensing control signal has the active level, the sweeping signal has the inactive level and the grayscale data voltage is a main data voltage.

5. The display apparatus of claim 4, wherein, in a third period of the display mode subsequent to the second period of the display mode, the scan signal has an inactive level, the sensing control signal has the active level and the sweeping signal has the inactive level.

6. The display apparatus of claim 5, wherein, in a fourth period of the display mode subsequent to the third period of the display mode, the scan signal has the inactive level, the sensing control signal has an inactive level, the sweeping signal is gradually increased, the first transistor is configured to be turned on and the third transistor is configured to be turned off so that the light emitting element is configured to emit a light.

7. The display apparatus of claim 6, wherein, in a fifth period of the display mode subsequent to the fourth period of the display mode, the scan signal has the inactive level, the sensing control signal has the inactive level, the sweeping signal is gradually increased, the third transistor is configured to be turned on and the first transistor is configured to be turned off so that the light emitting element is configured not to emit the light.

8. The display apparatus of claim 2, further comprising:

a first switch including a first end portion electrically connected to the input electrode of the fifth transistor and a second end portion configured to receive the initialization voltage;

a second switch including a first end portion electrically connected to the input electrode of the fifth transistor and a second end portion electrically connected to an analog to digital converter; and a sensing capacitor electrically connected to the input electrode of the fifth transistor.

9. The display apparatus of claim 8, wherein, in a first period of a first sensing mode to sense a characteristic of the first transistor, the scan signal has an inactive level, the sensing control signal has an inactive level, a first switch control signal applied to the first switch has an active level and a second switch control signal applied to the second switch has an inactive level.

10. The display apparatus of claim 9, wherein, in a second period of the first sensing mode subsequent to the first period of the first sensing mode, the scan signal has an active level, the sensing control signal has an active level, the first switch control signal has the active level and the second switch control signal has the inactive level.

11. The display apparatus of claim 10, wherein, in a third period of the first sensing mode subsequent to the second period of the first sensing mode, the scan signal has the inactive level, the sensing control signal has the active level, the first switch control signal has an inactive level, the second switch control signal has the inactive level and a first sensing voltage is gradually charged at the sensing capacitor.

12. The display apparatus of claim 11, wherein, in a fourth period of the first sensing mode subsequent to the third period of the first sensing mode, the scan signal has the active level, the sensing control signal has the inactive level, the first switch control signal has the inactive level, the second switch control signal has an active level and the first sensing voltage is outputted from the sensing capacitor to the analog to digital converter.

13. The display apparatus of claim 8, wherein, in a first period of a second sensing mode to sense a characteristic of the third transistor, the scan signal has an inactive level, the sensing control signal has an inactive level, a first switch control signal applied to the first switch has an active level and a second switch control signal applied to the second switch has an inactive level.

14. The display apparatus of claim 13, wherein, in a second period of the second sensing mode subsequent to the first period of the second sensing mode, the scan signal has an active level, the sensing control signal has an active level, the first switch control signal has the active level and the second switch control signal has the inactive level.

15. The display apparatus of claim 14, wherein, in a third period of the second sensing mode subsequent to the second period of the second sensing mode, the scan signal has the inactive level, the sensing control signal has the active level, the first switch control signal has an inactive level, the second switch control signal has the inactive level, the sweeping signal is gradually increased and a second sensing voltage is gradually charged at the sensing capacitor.

16. The display apparatus of claim 15, wherein, in a fourth period of the second sensing mode subsequent to the third period of the second sensing mode, the scan signal has the inactive level, the sensing control signal has the inactive level, the first switch control signal has the inactive level, the second switch control signal has an active level and the second sensing voltage is outputted from the sensing capacitor to the analog to digital converter.

17. A display apparatus comprising:

a display panel including a pixel;

a gate driver configured to output a gate signal to the pixel; and a data driver configured to output a data voltage to the pixel, wherein the pixel comprises:

a first transistor including a control electrode electrically connected to a first node, an input electrode configured to receive a first power voltage and an output electrode electrically connected to a first electrode of a light emitting element;

a second transistor including a control electrode configured to receive a scan signal, an input electrode configured to receive a grayscale data voltage and an output electrode electrically connected to a second node;

a third transistor including a control electrode electrically connected to the second node, an input electrode configured to receive a reference voltage and an output electrode electrically connected to the first node;

a fourth transistor including a control electrode configured to receive the scan signal, an input electrode configured to receive a bias data voltage and an output electrode electrically connected to the first node;

a fifth transistor including a control electrode configured to receive a sensing control signal, an input electrode configured to receive an initialization voltage and an output electrode electrically connected to the first electrode of the light emitting element; and the light emitting element including the first electrode and a second electrode configured to receive a second power voltage.

18. The display apparatus of claim 17, wherein the pixel further comprises:

a storage capacitor including a first end portion electrically connected to the first node and a second end portion electrically connected to the first electrode of the light emitting element; and a sweeping capacitor including a first end portion configured to receive a sweeping signal and a second end portion electrically connected to the second node.

19. The display apparatus of claim 18, wherein the pixel is configured to operate in one of a display mode, a first sensing mode and a second sensing mode, wherein, in the display mode, the pixel is configured to display an image based on the grayscale data voltage, wherein, in the first sensing mode, a characteristic of the first transistor is sensed, and wherein, in the second sensing mode, a characteristic of the third transistor is sensed.

20. The display apparatus of claim 19, wherein the display panel is configured to be driven in a unit of a frame, wherein the frame includes an active period when the grayscale data voltages are sequentially written to the pixels and a vertical blank period when the gray scale data voltages are not written to the pixels, wherein the first sensing mode is configured to be operated in the vertical blank period, and wherein the second sensing mode is configured to be operated in a power off duration when the display apparatus is turned off.

21. The display apparatus of claim 19, wherein the display panel is configured to be driven in a unit of a frame, wherein the frame includes an active period when the grayscale data voltages are sequentially written to the pixels and a vertical blank period when the gray scale data voltages are not written to the pixels, wherein the first sensing mode is configured to be operated in the vertical blank period, and wherein the first sensing mode and the second sensing mode are configured to be operated in a power off duration when the display apparatus is turned off.

22. The display apparatus of claim 19, wherein the display panel is configured to be driven in a unit of a frame, wherein the frame includes an active period when the grayscale data voltages are sequentially written to the pixels and a vertical blank period when the gray scale data voltages are not written to the pixels, and wherein the first sensing mode and the second sensing mode are configured to be operated in the vertical blank period.

* * * * *